US006971686B2

(12) United States Patent
Becken

(10) Patent No.: US 6,971,686 B2
(45) Date of Patent: Dec. 6, 2005

(54) MULTIPOINT LOCK SYSTEM

(75) Inventor: Donald A. Becken, Burbank, CA (US)

(73) Assignee: Truth Hardware Corporation, Owatonna, MN (US)

( * ) Notice: Subject to any disclaimer, the term of this patent is extended or adjusted under 35 U.S.C. 154(b) by 39 days.

(21) Appl. No.: 10/399,466

(22) PCT Filed: Oct. 19, 2001

(86) PCT No.: PCT/US01/45585

§ 371 (c)(1),
(2), (4) Date: Oct. 31, 2003

(87) PCT Pub. No.: WO02/33202

PCT Pub. Date: Apr. 25, 2002

(65) Prior Publication Data

US 2004/0066046 A1 Apr. 8, 2004

Related U.S. Application Data

(60) Provisional application No. 60/241,683, filed on Oct. 19, 2000, provisional application No. 60/241,684, filed on Oct. 19, 2000.

(51) Int. Cl.[7] ..... E05C 1/06
(52) U.S. Cl. ..... 292/39; 292/142; 292/172; 292/332; 292/DIG. 21
(58) Field of Search ..... 292/39, 142, 172, 292/DIG. 21, 332–335

(56) References Cited

U.S. PATENT DOCUMENTS

| | | | | |
|---|---|---|---|---|
| 958,880 | A * | 5/1910 | Lawson | 292/335 |
| 4,973,091 | A | 11/1990 | Paulson et al. | |
| 5,197,771 | A | 3/1993 | Kaup et al. | |
| 5,373,716 | A | 12/1994 | MacNeil et al. | |
| 5,498,038 | A | 3/1996 | Simon et al. | |
| 5,524,942 | A | 6/1996 | Fleming | |
| 5,906,403 | A | 5/1999 | Bestler et al. | |
| 6,209,931 | B1 | 4/2001 | Von Stoutenborough et al. | |
| 6,217,087 | B1 * | 4/2001 | Fuller | 292/39 |

FOREIGN PATENT DOCUMENTS

DE 2914377 * 10/1980

* cited by examiner

*Primary Examiner*—Brian E. Glessner
*Assistant Examiner*—Carlos Lugo
(74) *Attorney, Agent, or Firm*—Patterson, Thuente, Skaar & Christensen, P.A.

(57) ABSTRACT

A multipoint lock system for use with the active and inactive doors of two-door sets, which provides an operator with the ability to lock or unlock a plurality of locking points both manually and automatically, and features a blocking mechanism to prevent unwanted locking. The system comprises a pair of releasably engaged mechanisms, one of which primarily controls the deployment of the locking members, while the other primarily controls the receiving windows that receive the locking members. Each mechanism is operated by a lever and thumbturn attached to a centralized cassette.

40 Claims, 35 Drawing Sheets

MULTIPOINT LOCK SYSTEM

CROSS-REFERENCE TO RELATED APPLICATIONS

This application is the national stage of International Application No. PCT/US01/45585, filed Oct. 19, 2001 and published in English under PCT Article 21(2), which claims the benefit of U.S. Provisional Application Nos. 60/241,683, filed Oct. 19, 2000, and 60/241,684, filed Oct. 19, 2000, the contents of which are incorporated by reference herein.

BACKGROUND OF THE INVENTION (1) Field of the Invention

The present invention relates generally to door locks and more specifically to an improved multipoint door lock system for controlling locking and unlocking of the inactive and active doors of a two-door set.

(2) Description of the Related Art

Many patio or other entryways utilize two swinging or sliding doors that meet in the middle of the doorway as opposed to a single door. When a two-door configuration is used, one door is referred to as the active door and the other is referred to as the inactive door. The active door is the door that swings open when an operator attempts to open it by using a handle or lever, while the inactive door is the door that generally remains closed or locked except for circumstances where a wider entryway is needed. Generally, the doors are mounted on a frame by a set of hinges for swinging door applications or on a track for sliding door applications.

As is common in the art, the primary locking mechanism used to lock the inactive door is either a shootbolt or a flushbolt and is usually operated manually. The inactive door also includes a strike plate positioned to receive a latchbolt from the active door to maintain both doors in a closed condition. The active door typically includes a recessed latch/lock assembly to facilitate use of the active door. A handle or lever attached to the assembly manually controls the latchbolt thereby enabling the door to be opened or closed. A retractable deadbolt operated by a thumbturn or the like is frequently associated with the latchbolt to provide extra locking security to the doors.

Although conventional door lock assemblies as described above have performed their latching or locking functions in a generally satisfactory manner, there is a continuing desire and need for further improvements in high security lock assemblies designed to safely and positively lock a door against unauthorized entry. To this end, the use of dual deadbolt locks have increasingly become the standard in that two locks provide even greater security than one. Furthermore, multipoint lock assemblies have been proposed wherein multiple lock members are provided along the side edge of a door for engaging a corresponding number of keeper plates mounted on an adjacent doorjamb. Multiple locks, however, require additional time and effort on the part of an operator to lock or unlock them, but provide the greater security. In some cases, the multiple lock members are designed for independent actuation, with the unfortunate result that frequently only one of the lock members is engaged due to human forgetfulness and/or neglect. In other designs, the multiple lock members are adapted for concurrent actuation from a single actuator lever or handle, but these systems have tended to be difficult to assemble and install in a cost effective manner, especially if the door frame requires the addition of an astragal. Additionally, many of the conventional multipoint lock systems do not address the problem of accidental lockouts and accidental damage to the doorframe when the user attempts to force open an active door, which is assumed to be unlocked.

For the foregoing reasons, there is a need for an improved multipoint lock assembly that is easy to operate, manufacture and install, provides a safeguard against accidental lockouts and accidental damage to the door frame, is easily adaptable to varying door configurations whether or not an astragal is employed, and provides a high degree of security and peace of mind to the user.

SUMMARY OF THE INVENTION

The present invention is directed to an apparatus that satisfies the needs set forth above by providing an improved multipoint lock system. A multipoint lock system having features of the present invention comprises a first lock mechanism having a deployed and retracted condition and a second lock mechanism having an open and blocked condition. The system is designed so that the first lock mechanism engages the second lock mechanism via a set of locking points when the second lock mechanism is in the open condition and the first lock mechanism is prevented from engaging the second lock mechanism when the second lock mechanism is in the blocked condition. The system also allows for the incorporation of a unique multi-tiered actuator system into the first lock mechanism, which provides this mechanism with an automatic locking function and a manual locking function. Key to the automatic locking function is a sensor-trigger unit, whereby at least one sensor-trigger mechanism attached to the first lock mechanism and having at least one sensor-trigger contacts at least one sensor pad attached to the second lock mechanism allowing the first lock mechanism to automatically engage the second lock mechanism. Should the automatic locking function fail, the manual locking function allows a user to manually engage the first lock mechanism with the second lock mechanism.

The first lock mechanism of the multipoint lock system comprises a first cassette, a first primary actuator housed within the first cassette, and a first input device, typically a lever or handle, for operating the first primary actuator. The first primary actuator drives a latching member, typically a latchbolt, between a first latching member retracted position and a first latching member deployed position, and also drives at least one primary remote actuator, between a first primary remote actuator extended position and a first primary remote actuator retracted position. The first lock mechanism also comprises a locking member, typically a deadbolt, and at least one primary remote locking point, typically a deadbolt lock, tongue lock, shootbolt, or any combination thereof. The locking member is driven by a first lock actuator between a locking member retracted position and a locking member deployed position. A second input device, which is typically a thumbturn, operates the first lock actuator.

The second lock mechanism of the multipoint lock system comprises at least one faceplate having a series of windows namely, a first receiver window for receiving the latching member, a second receiver window for receiving the locking member, and at least one remote receiver window for receiving at least one primary remote locking point. Mounted to the faceplate is a second cassette having a housing, the housing further defining the first receiver window and the second receiver window. A second primary actuator, which is operated by a third input device, typically a lever or handle, is housed within the second cassette. The second primary actuator drives at least one secondary remote actuator between a secondary remote actuator extended position and a second remote actuator retracted position. To prevent the first lock mechanism from engaging the second lock mechanism, a first receiver window blocker, which blocks the first window, a second receiver window blocker, which blocks the second window, and at least one remote receiver window blocker, which blocks at least one remote receiver window, are provided, all of which are driven by at least one secondary remote actuator between their respective retracted (unblocking) and deployed (blocking) positions. The second lock mechanism also includes at least one secondary remote locking point driven by the movement of at least one secondary remote actuator between a secondary remote locking point retracted position and a secondary remote locking point deployed position.

The present invention described above is typically used to lock swinging doors of a two door set, in which case the first lock mechanism can be attached to the active door of a two-door set, while the second lock mechanism can be attached to the inactive door of the two-door set. However, this invention can also be used in other door applications including but not limited to, sliding two-door sets, single swinging doors and single sliding doors.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

At the outset, the invention is described in its broadest overall aspects with a more detailed description following. Essentially, the invention, a multipoint lock system, comprises a first lock mechanism and a second lock mechanism, the second lock mechanism having an open condition and a blocked condition, wherein the first lock mechanism engages the second lock mechanism when the second lock mechanism is in the open condition, and wherein the first lock mechanism is prevented from engaging the second lock mechanism when the second lock mechanism is in the blocked condition. In sum, when the first and second lock mechanisms are engaged, the members (e.g., doors) to which these mechanisms are attached are locked in a closed position.

Figure 1:
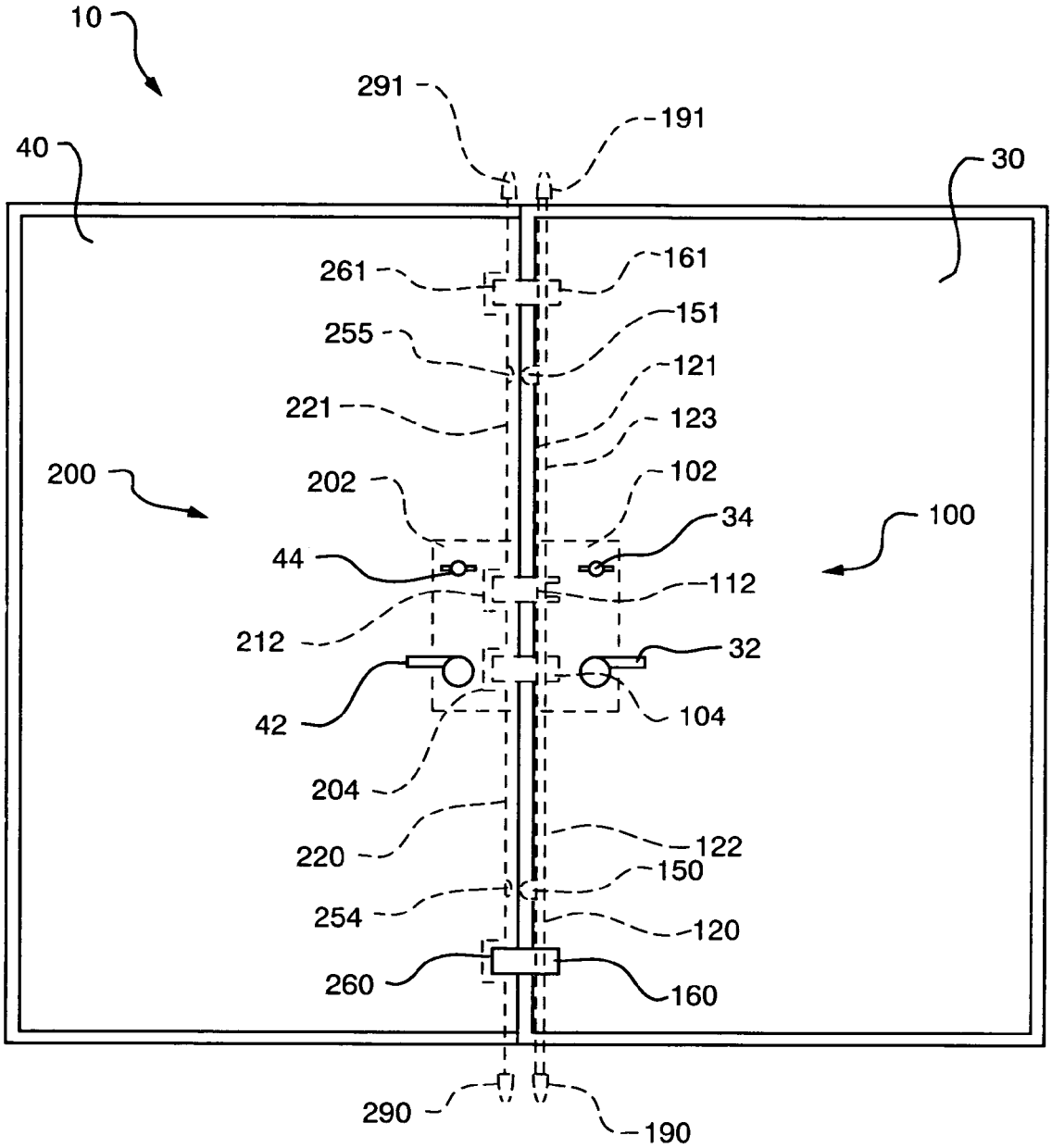
FIG. 1 is an elevational view of a door set having a multipoint lock system whereby the doors are shown in a locked condition.
Figure 2:
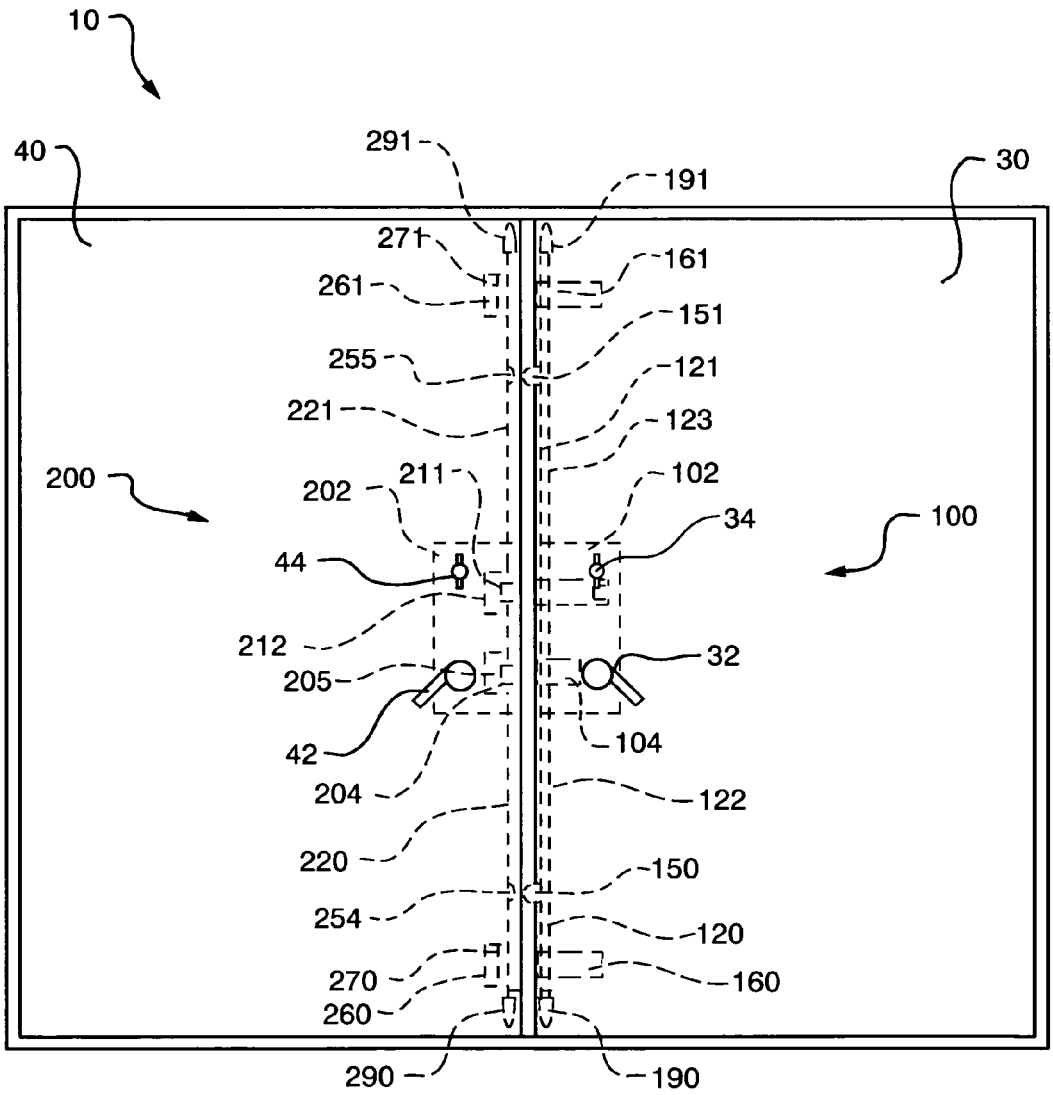
FIG. 2 is an elevational view of a door set having a multipoint lock system whereby the doors are shown in an unlocked condition.
Figure 3:
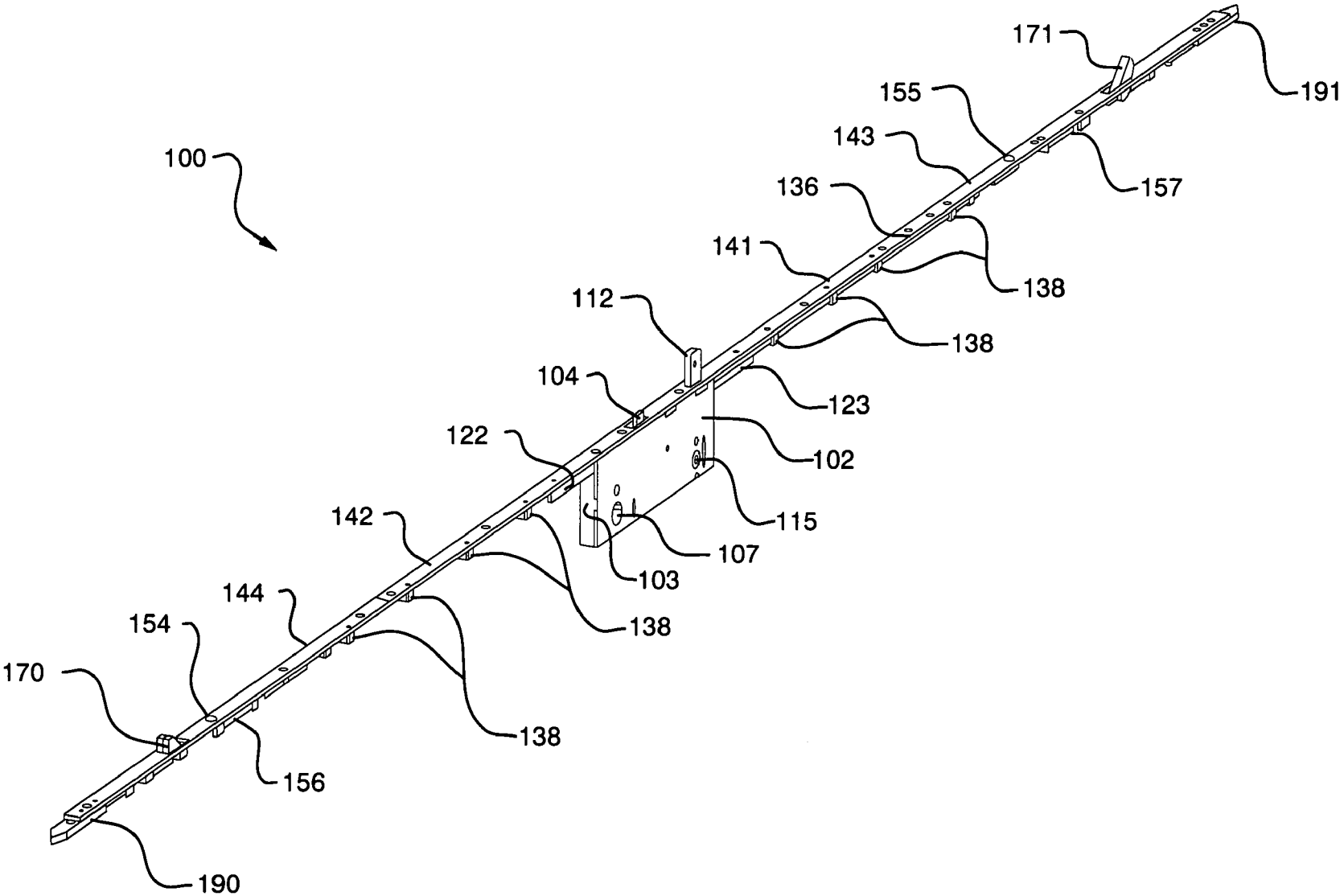
FIG. 3 is a frontal perspective view of the first lock mechanism having tongue lock remote locking members.
Figure 4:
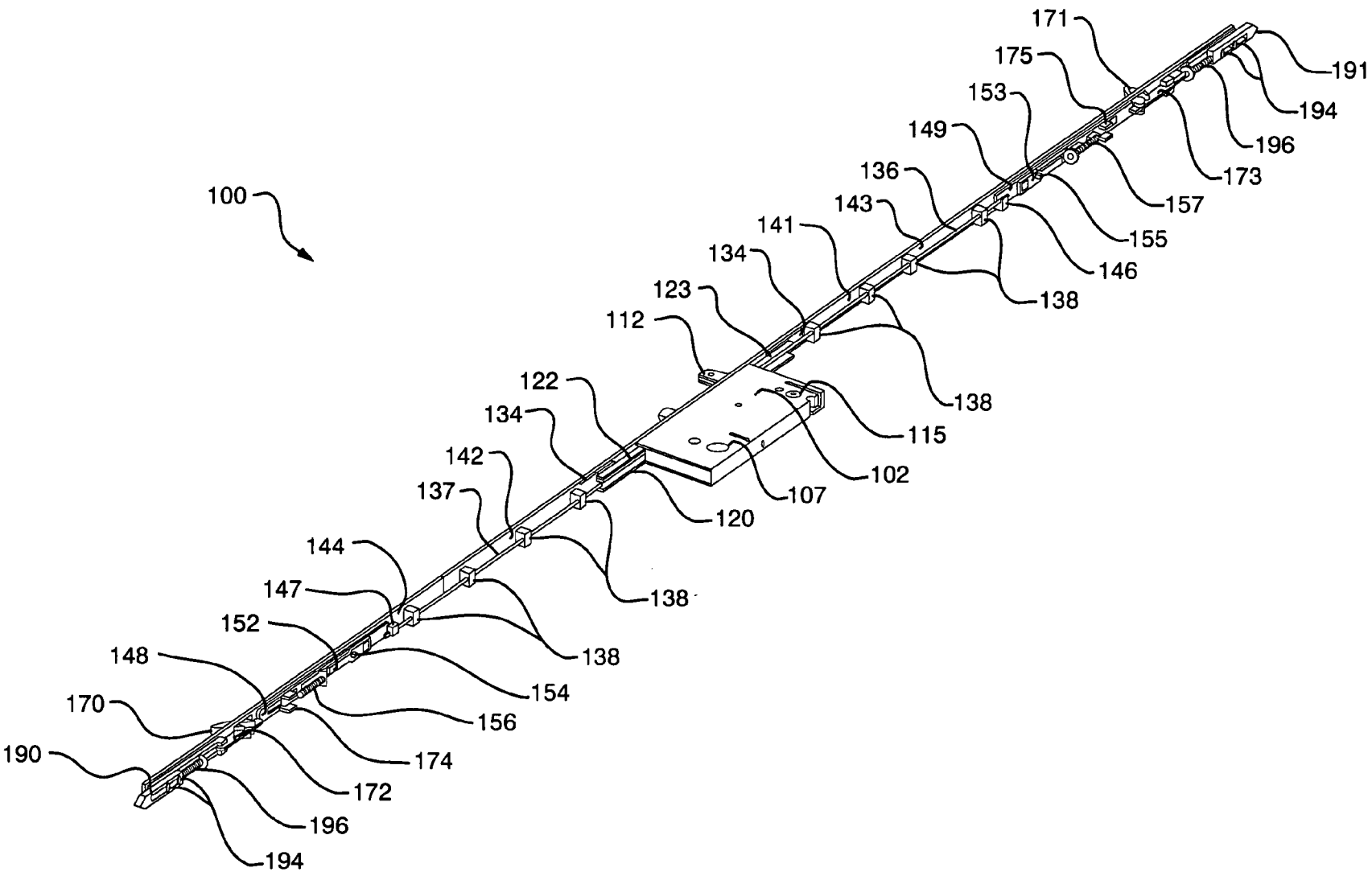
FIG. 4 is a rear perspective view of the first lock mechanism of FIG. 3.

Referring to FIGS. 1–2, a multipoint lock system 10, which is adaptable to swinging and sliding two-door sets and other door applications including but not limited to single swinging doors and sliding doors, is shown in the locked condition (FIG. 1) and the unlocked condition (FIG. 2). The multipoint lock system 10 is comprised of two independent co-acting lock mechanisms, namely first lock mechanism 100 and second lock mechanism 200. The first lock mechanism 100 and the second lock mechanism 200 work in conjunction with each other to operate, i.e., open/close, lock/unlock a set of doors. Regarding the locking functions, the multipoint lock system 10 provides both automatic (i.e., automatic deployment of locking points) and manual (i.e., manual deployment of locking points) locking functions for added security.

In one embodiment of the invention, the first lock mechanism 100 is embedded into the leading edge of an active door 30 of a two-door set, while the second lock mechanism 200 is embedded in the leading edge of a corresponding inactive door 40 of said two-door set. Typically, the active door 30 is the primary door used for ingress/egress while the inactive door 40 generally remains in the closed position, but can be opened when the need arises. The first lock mechanism 100 generally comprises: a first cassette 102, a latching member 104, typically a latchbolt, a locking member 112, typically a deadbolt, and at least one primary remote actuator, or in the case of one embodiment, two sets of primary remote actuators 120,122 and 121,123. Additionally, the first lock mechanism 100 comprises: at least one primary remote locking point, or in the case of one embodiment of the invention, a combination of primary remote locking points including remote locking points 160 and 161, typically tongue locks, deadbolt locks or any other suitable locking components, and remote locking points 190 and 191, typically shootbolts or extension bolts, and, at least one sensor trigger mechanism, or in the case of one embodiment of the invention, two sensor-trigger mechanisms 150 and 151. The active door lock mechanism is controlled through the use of a first input device 32, typically a lever or handle, and a second input device 34, typically a knob or thumbturn.

The second lock mechanism 200, which releasably engages the first lock mechanism 100, generally comprises: a second cassette 202, a first receiver window 204 for receiving said latching member 104, a second receiver window 212 for receiving said locking member 106, at least one secondary remote actuator, or in the case of one embodiment of the invention, a pair of secondary remote actuators 220 and 221, at least one remote receiver window, or in the case of one embodiment of the invention, a pair of remote receiver windows 260 and 261 for receiving said primary remote locking points 160 and 161, and, at least one sensor pad, or in the case of one embodiment of the invention, two sensor pads 254 and 255. The second lock mechanism further includes at least one secondary remote locking point, or in the case of one embodiment of the invention, a pair of secondary remote locking points 290 and 291, typically shootbolts or extension bolts. Referring to FIG. 2, the second lock mechanism 200 also employs a first receiver window blocker 205 for blocking said first receiver window 204, a second receiver window blocker 211 for blocking said second receiver window 212, and at least one remote receiver window blocker, or in the case of one embodiment of the invention, a set of remote window blockers 270 and 271 for blocking said remote receiver windows 260 and 261 accordingly. The second lock mechanism 200 is controlled through the use of a third input device 42, typically a lever or handle, and a fourth input device 44, typically a knob or thumbturn. Having thus broadly described the multipoint lock system 10, a more detailed description of its comprising features will be given below.

Referring to FIGS. 3–6, the first lock mechanism 100 is shown. The first lock mechanism 100 comprises a first cassette 102, which operates the mechanism. The first cassette 102 is generally located in a central location upon the first lock mechanism 100, but can be located at any feasible location. The first cassette 102 is mounted to a first faceplate 141 and a second faceplate 142 via mechanical fasteners such as screws. Attached to the first faceplate 141 and the second faceplate 142 via mechanical connections and or linkages are a third faceplate 143 and fourth faceplate 144 respectively. The abovementioned active door faceplates 141,142,143,144 are mounted flush to the active door 30 via mechanical fasteners, such as screws, and provide a support base for the first lock mechanism components described below. It should be noted that although four faceplates are used in the embodiment described herein, any desirable number of faceplates from one to a plurality, can be employed provided that proper rigidity is maintained to support the mechanism and prevent the active door 30 from warping.

Figure 5:
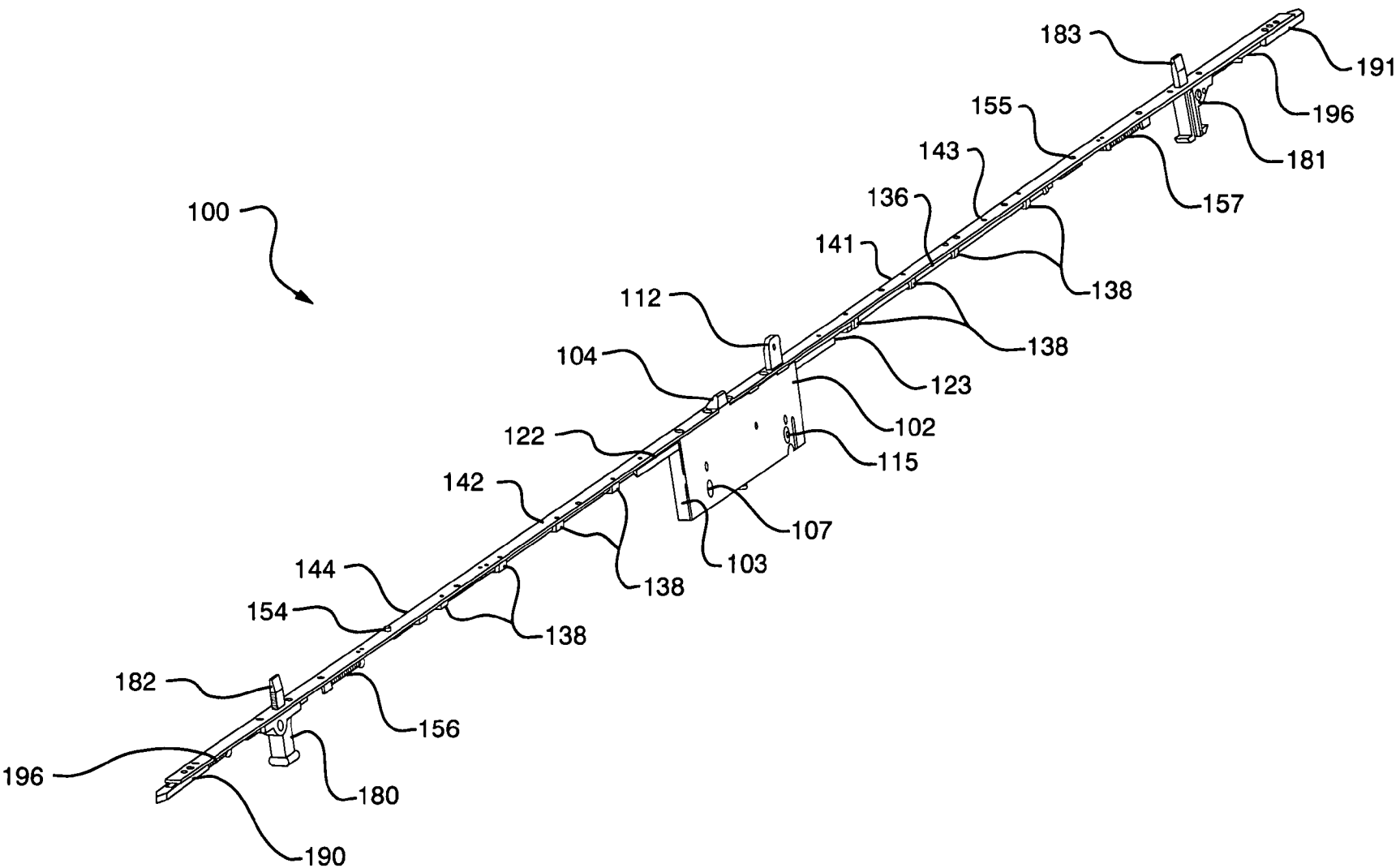
FIG. 5 is a frontal perspective view of the first lock mechanism having deadbolt lock remote locking members.
Figure 6:
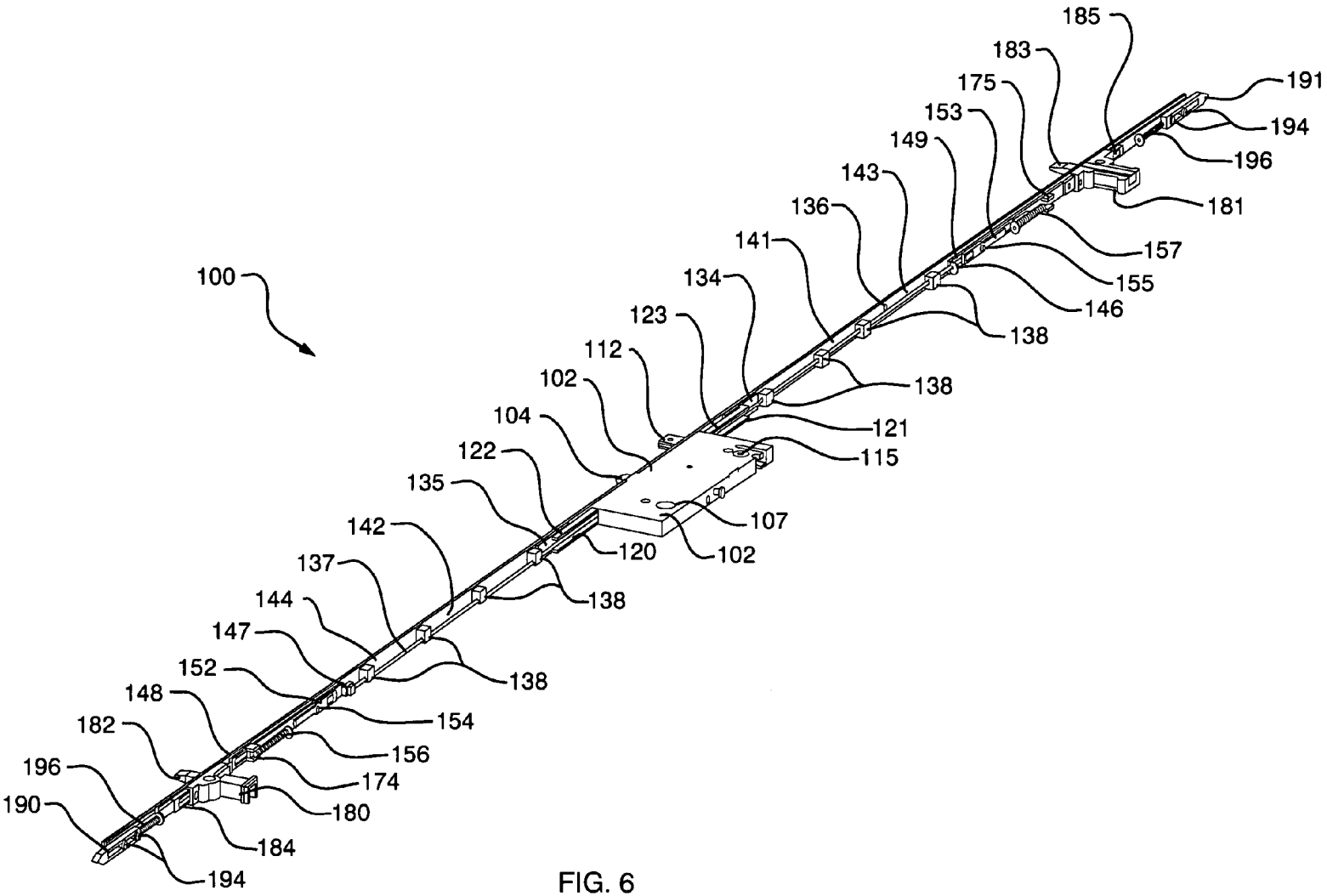
FIG. 6 is rear perspective view of the first lock mechanism of FIG. 5.

Extending outward from the first cassette 102 in either direction are a set of primary remote actuators; more specifically, a first primary remote actuator lower tier 120 and a first primary remote actuator upper tier 122, extending outward in one direction, and a second primary remote actuator lower tier 121 and a second primary remote actuator upper tier 123, extending outward in the opposite direction. These actuators, along with other components that will be addressed later, form a multi-tiered remote actuator system having an upper tier and a lower tier, which drives the primary remote locking points 160,161,190,191. The first remote actuators upper and lower tier 120 and 122, and the second remote actuators upper and lower tier 121 and 123, slidably engage remote actuator connector slides 134 and 135 respectively. Attached to the primary remote actuator connector slides 134 and 135 are actuator rods 136 and 137 respectively. The actuator rods 136 and 137 are each guided and supported by a series of rod guides 138. At the ends opposite to where the actuator rods 136 and 137 attach to the remote actuator connector slides 134 and 135, the actuator rods 136 and 137 are connected to primary remote slides 148 and 149 via rod connectors 146 and 147 respectively. Slidably engaged with the primary remote slides 148 and 149 are sensor slides 152 and 153, which make up part of the senor-trigger mechanisms 150 and 151. Also attached to the remote slides 148 and 149 are a pair of remote locking points 160 and 161 (FIGS. 1–2), more specifically, tongue locks 170 and 171 if tongue locks are employed (FIGS. 3–4) or deadbolt locks 180 and 181 if deadbolt locks are employed (FIGS. 5–6). Finally, the remote locking points 160 and 161 are respectively linked to a separate pair of remote locking points 190 and 191, typically spring-loaded shootbolts, which engage either the head or sill of the active door 30 depending on the arrangement of the first lock mechanism 100.

Figure 7A:
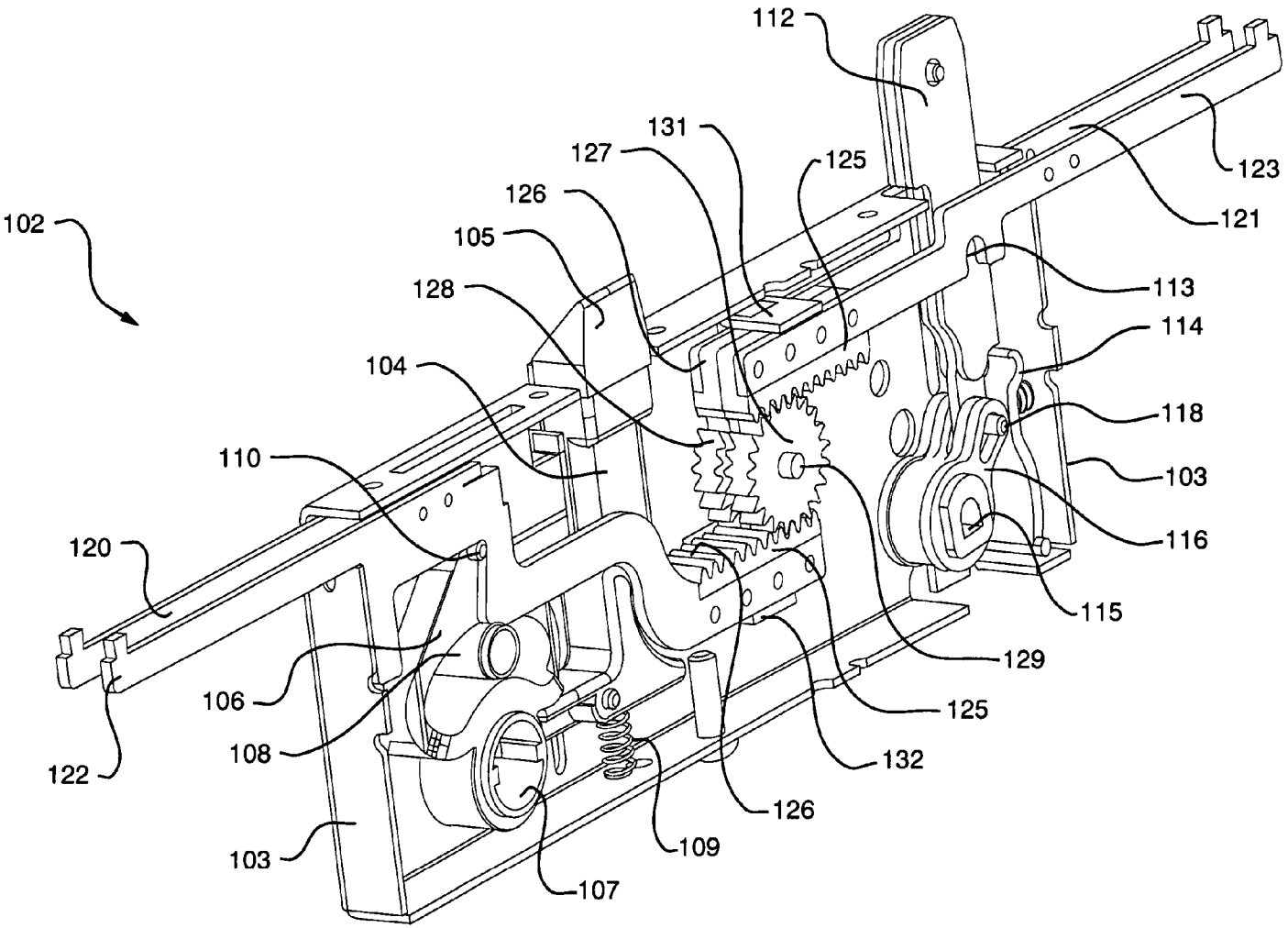
FIG. 7*a* is an elevated perspective view of the first cassette of the first lock mechanism with cover removed and latchbolt and primary deadbolt deployed.
Figure 7B:
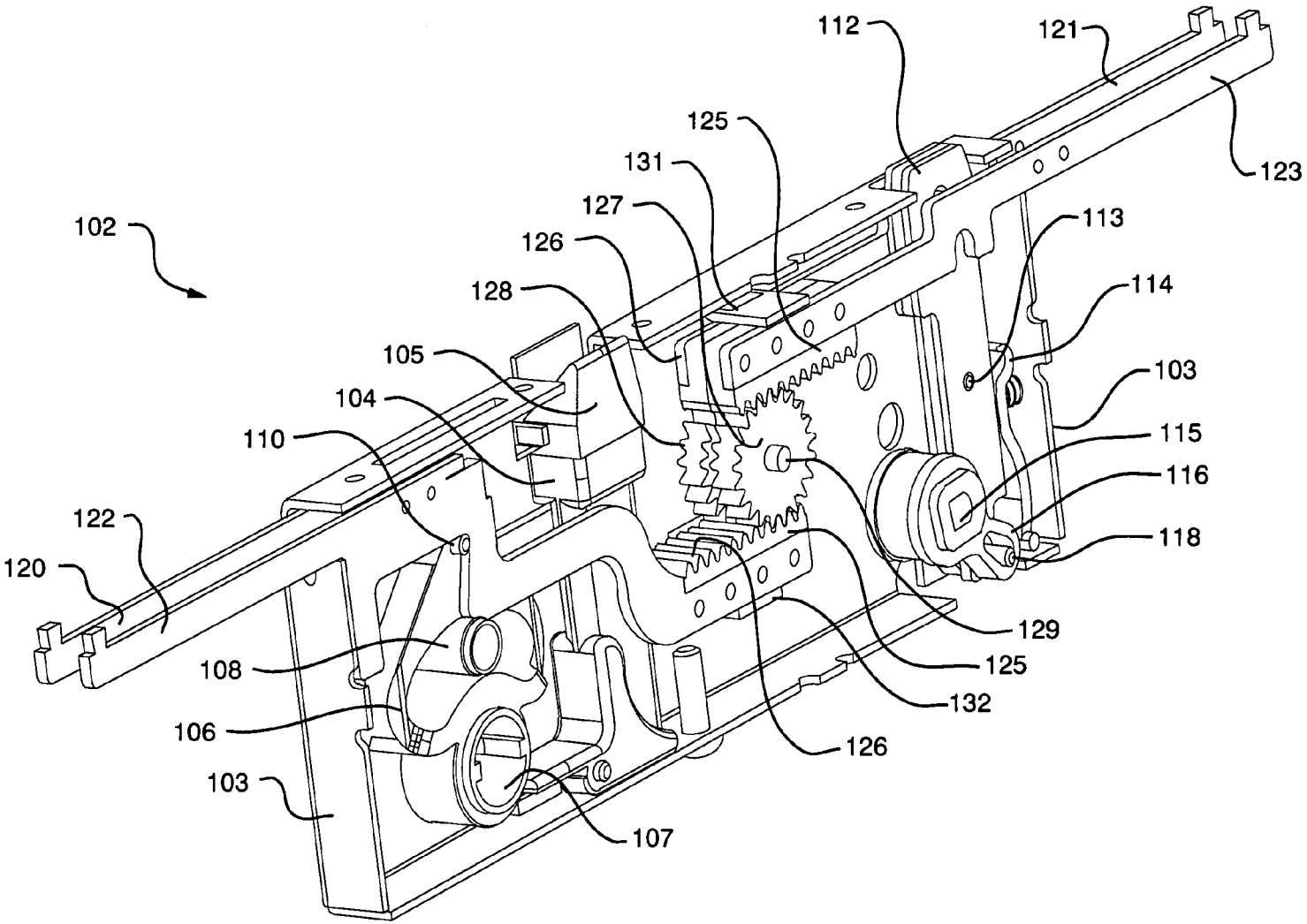
FIG. 7*b* is an elevated perspective view of the first cassette of the first lock mechanism with cover removed and latchbolt and primary deadbolt retracted.
Figure 8:
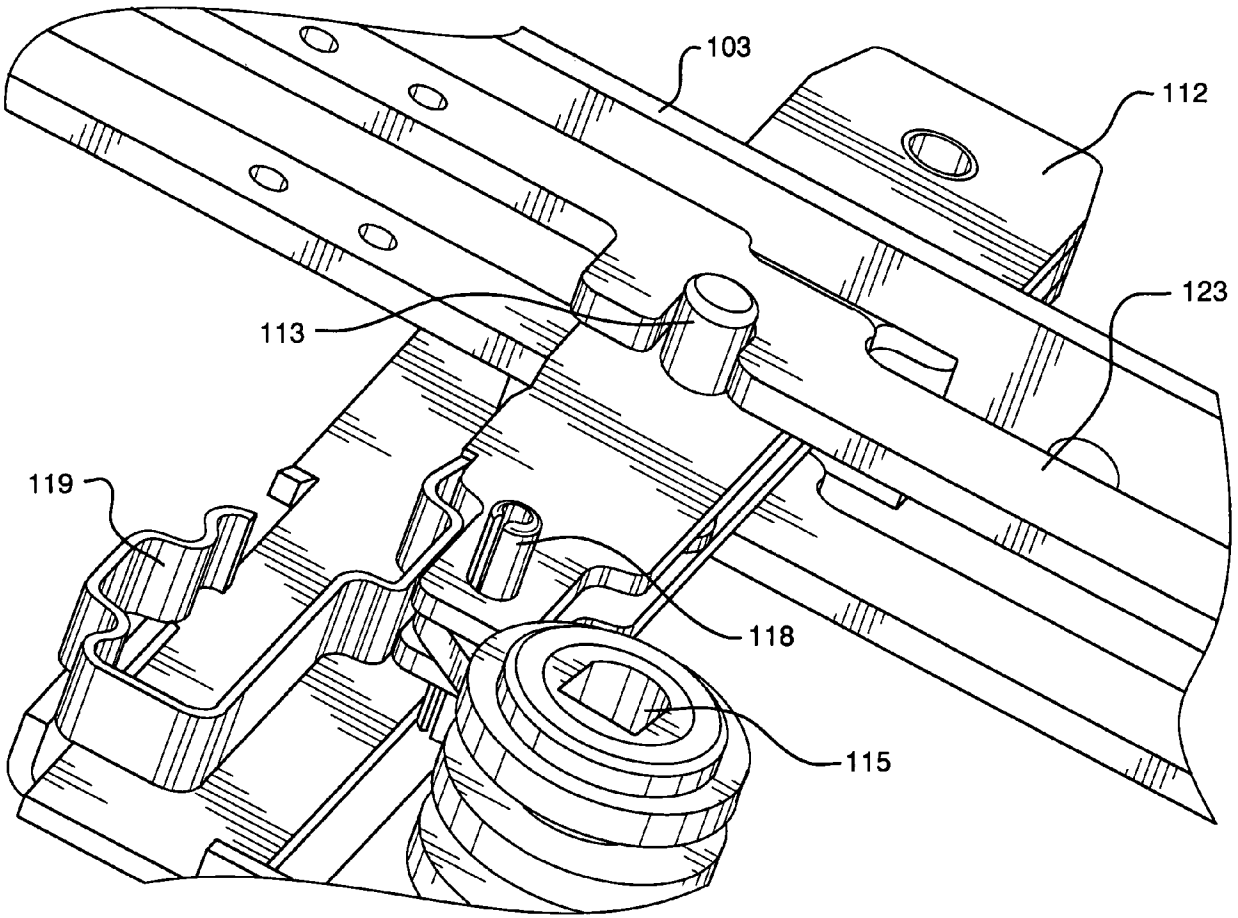
FIG. 8 is a close-up view of the primary deadbolt of the first lock mechanism in the deployed position.

Referring now to FIGS. 7*a*, 7*b* and 8, the first cassette 102 of the first lock mechanism 100 is shown in more detail by removing its cover to expose its internal components. In general, the first cassette 102 itself comprises a typical rectangular shaped housing 103, which may be conveniently and economically constructed from cast metal or molded plastic components or the like. The first cassette 102 houses a first primary actuator 106, which comprises a latching member hub 107 for receiving the first input device 32, and a locking member actuator 116, which comprises a locking member hub 115 for receiving the second input device 34.

Focusing on the first primary actuator 106, a clearance tube 108 is positioned in a central slot within the actuator 106 to guide the actuator 106 and prevent the housing from interfering with the moving parts inside the first cassette 102. At the tip of the actuator 106 is journaled a remote actuator drive pin 110, which in conjunction with the movement of the first primary actuator 106, drives the first primary remote actuators lower and upper tier 120,122 and the second primary remote actuators lower and upper tier 121,123. The first primary actuator 106 is in contact with the retractable latching member, typically a latchbolt 104. At one end of the latchbolt 104 is attached a return spring 109, which imparts a spring-loaded action to the latchbolt 104, while at the other end a latchbolt tip 105 is attached. The latchbolt tip 105 is removable and reversible to allow the multipoint lock system 10 to function in a non-handed manner, i.e., the system can be used in both right-handed and left-handed configurations.

Focusing on the locking member actuator 116, a connector pin 118 is provided to mechanically couple the locking member actuator 116 to the retractable locking member 112, typically a deadbolt. In one embodiment, a deadbolt 112 is employed, which comprises a series of hardened anti-saw pins (not shown) to provide added durability and security. To secure the locking member 112 in the deployed position (FIG. 7*a*), a lock spring 114 is used, which can be of the variety shown here, or of the variety shown in FIG. 8 whereby a leaf-type spring 119 is used, or of any other suitable spring variety. Embedded in the locking member 112 is a remote actuator lock pin 113, which releasably engages the second primary remote actuator upper tier 123 when the locking member 112 is deployed, thereby preventing both the second primary remote actuator upper tier 123 and the first primary remote actuator upper tier 122 from moving, but still allowing movement of the other primary remote actuators 120 and 121. This action, of course, can be changed by rearranging the set-up of the locking member 112 so that a different primary remote actuator tier is engaged; the end result, is that the primary remote actuator tier that is engaged by the locking member 112 is held in place, while the non-engaged primary remote actuator tier is free to move.

Focusing on the central portion of the first cassette 102, attention will now be drawn to a more detailed description of the multi-tiered actuator system previously noted. The multi-tiered actuator system comprises an upper tier comprising the first primary remote actuator upper tier 122 and the second primary remote actuator upper tier 123 and a lower tier comprising the first primary remote actuator lower tier 120 and the second primary remote actuator lower tier 121. These primary remote actuators 120,121,122,123 are linked via a multi-tiered rack and pinion system comprising: an upper tier pinion 127 and a lower tier pinion 128 rotatably supported and centered about a pinion axel 129, and an upper tier rack set 125 and a lower tier rack set 126, which engage the pinions 127,128 in a typical rack and pinion manner. The upper tier rack set 125 is mechanically attached to the first primary remote actuator upper tier 122 and the second primary remote actuator upper tier 123, while the lower tier rack set 126 is mechanically attached to the first primary remote actuator lower tier 120 and the second primary remote actuator lower tier 121, thereby creating the multi-tiered remote actuator system. This multi-tiered format allows the upper and lower tiers to operate independently of each other, i.e., the upper tier remote actuators 122 and 123 operate together and the lower tier remote actuators 120 and 121 operate together, but the upper tier remote actuators 122 and 123 operate independently of the lower tier remote actuators 120 and 121. In one embodiment of the invention, the lower tier remote actuators 120 and 121 accomplish the unlatch function and remote arming or automatic locking function (described below), while the upper tier remote actuators 122 and 123 accomplish the manual locking function, which overrides the automatic locking function (described in more detail below). To keep the remote actuators 120,122,123,124 from sliding out of position, a pair of remote actuator guides 131 and 132 attached to the first cassette housing 103 are utilized; said remotes actuator guides 131 and 132 align the remote actuators 121,122,123,124 via direct contact.

Figure 9A:
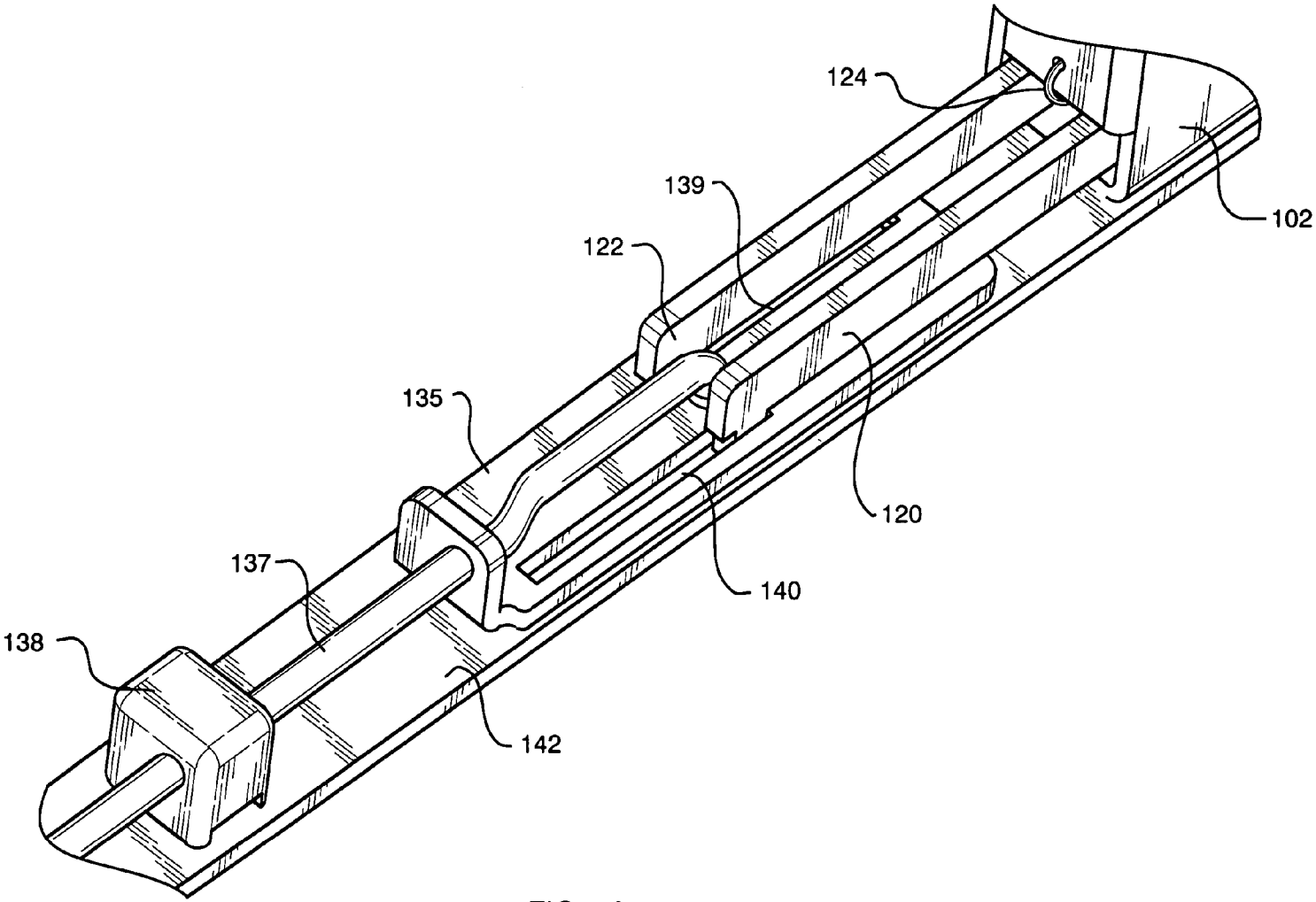
FIG. 9*a* is perspective view of a remote actuator connector slide of the first lock mechanism showing the remote actuators in the open door/remote locking points retracted position.
Figure 9B:
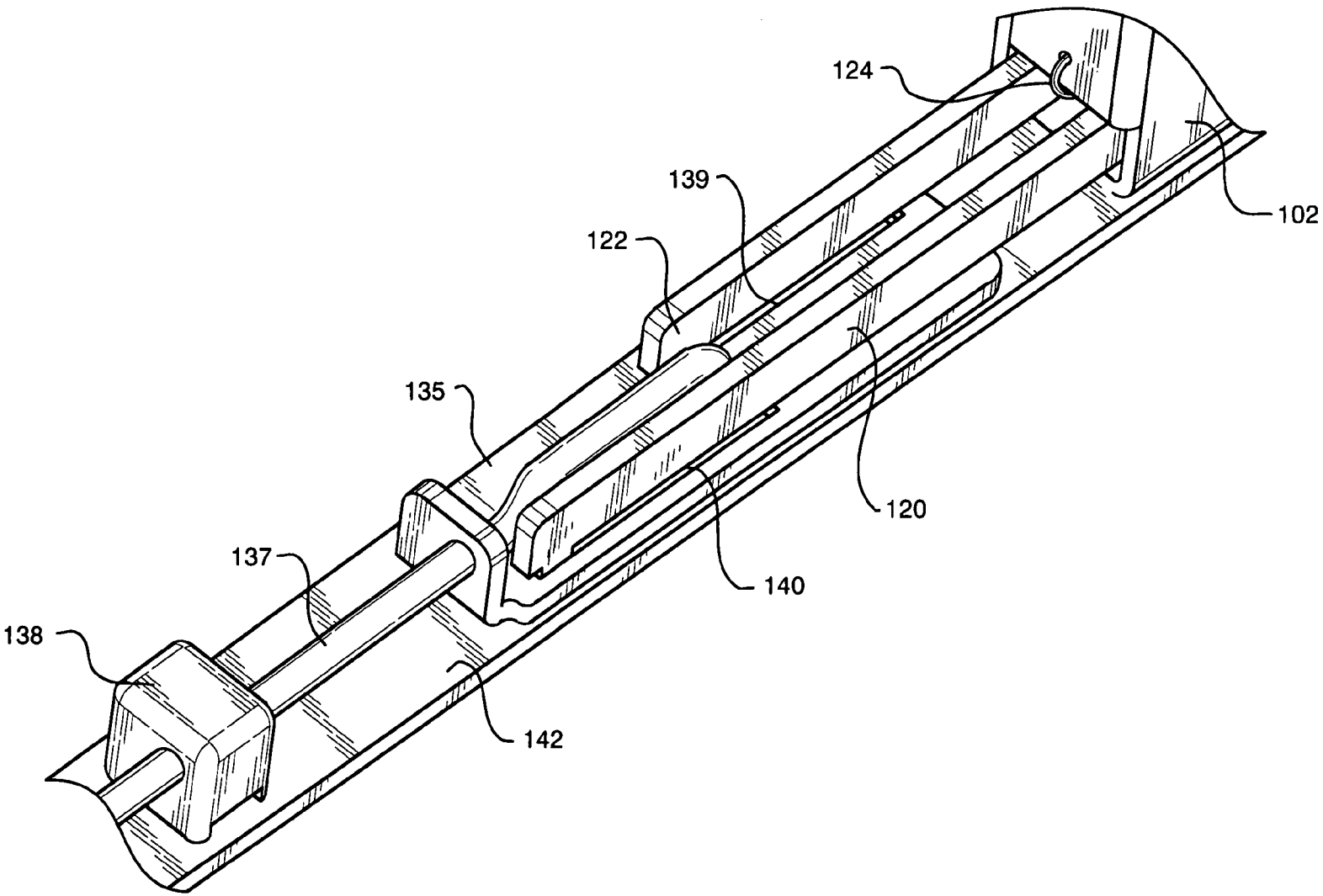
FIG. 9*b* is a perspective view of a remote actuator connector slide of the first lock mechanism showing the remote actuators in the neutral/remote locking points armed position.
Figure 9C:
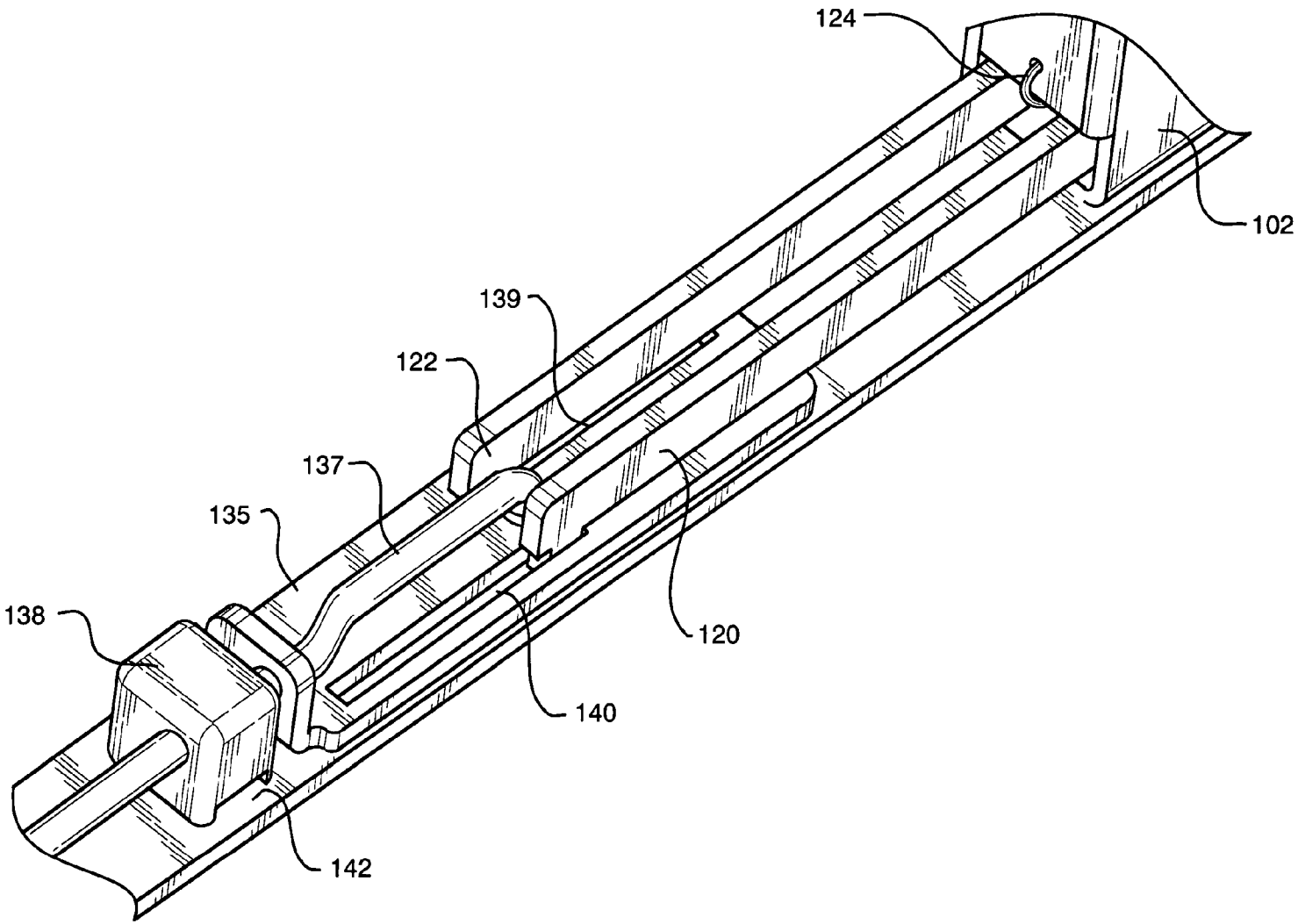
FIG. 9*c* is a perspective view of a remote actuator connector slide of the first lock mechanism showing the remote actuators in the neutral/remote locking points deployed position.
Figure 9D:
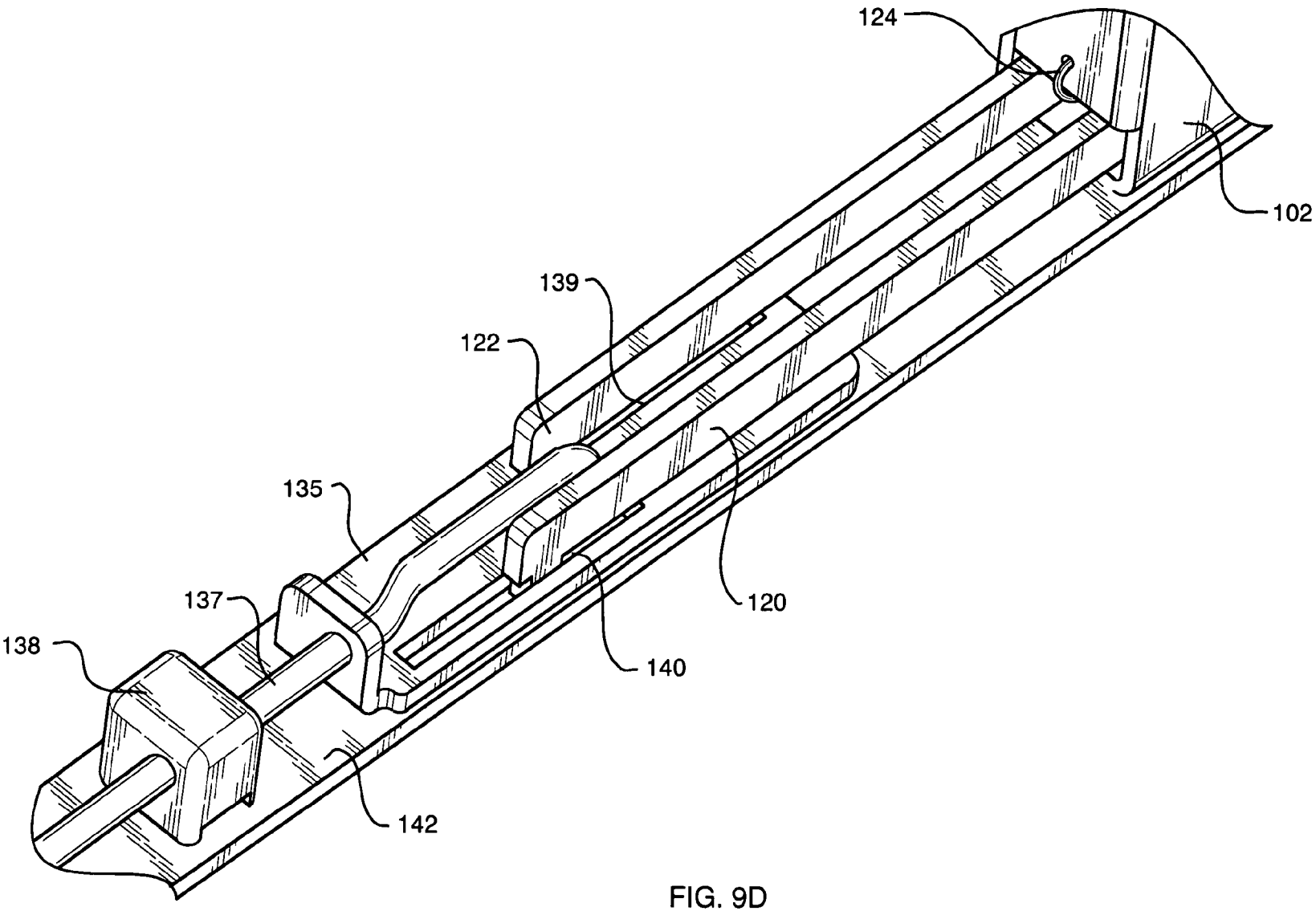
FIG. 9*d* is a perspective view of a remote actuator connector of the first lock mechanism showing the first remote actuator upper tier in the neutral position and the first remote actuator lower tier approximately halfway through the manual deployment function whereby the remote locking points are partially deployed.

Drawing attention to FIGS. 9*a*–9*d*, more detailed views of the position of the first primary remote actuators lower and upper tier 120 and 122 are shown with respect to the various modes of operation of the first lock mechanism 100. It should be noted that although the views depict the first remote actuators lower and upper tier 120 and 122, the second remote actuators function in the same manner. Furthermore, the arrangements herein presented represent one embodiment of the invention; therefore, alternative arrangements of the elements can be employed. As shown, the first primary remote actuator lower tier 120 and the first primary remote actuator upper tier 122 slidably engage the remote actuator connector slide 135 via a pair off offset slots 139 and 140, which are cut into said remote actuator connector slide 135. Each slot has a far end (away from the first cassette 102) and a near end (opposite the far end). The slots 139,140 are offset to allow specified movements of the remote actuator connector slide 135, each movement dependant upon the movement of the remote actuators 120,122, which ultimately coincide with the movement of the input device or handle 32. Movement of the remote actuator connector slide 135 moves the actuator rod 137, which positions the sensor-trigger mechanism 150, remote locking point 160 and shootbolt 190. FIG. 9*a* shows the position of the first primary remote actuators lower and upper tier 120 and 121 when the active door 30 is opened, which is facilitated by a downward movement of the handle 32 (not shown). In this condition, the first primary remote actuator lower tier 120 is positioned to the near end of slot 140, while the first primary remote actuator upper tier 122 is positioned to the far end of slot 139. FIG. 9*b* shows the first primary remote actuators 120 and 122 in a first neutral position, whereby the handle 32 is horizontal (not shown), and the first primary remote actuator lower tier 120 is positioned to the far end of slot the 140 and the first primary remote actuator upper tier 122 is positioned to the far end of the slot 139. In this condition, the sensor-trigger mechanism 150, remote locking point 160 and shootbolt 190 would be in the armed condition. FIG. 9*c* shows the first primary remote actuators lower and upper tier 120 and 122 in a second neutral position, whereby the handle 32 is horizontal (not shown), and the first primary remote actuator lower tier 120 is positioned to the near end of slot 140 and the second primary remote actuator upper tier 122 is positioned to the far end of slot 139. In this condition, the sensor-trigger mechanism 150, remote locking point 160 and shootbolt 190 would be in the deployed condition. Finally, FIG. 9*d* shows the first primary remote actuators lower and upper tier 120 and 122 in a third neutral position, whereby the handle 32 is partially upward (not shown), and the first remote actuator lower tier 120 is positioned halfway between the near and far ends of slot 140, and the second remote actuator upper tier 122 is positioned to the far end of slot 139. In this condition, the first remote actuator lower tier 120 is approximately halfway through the manual locking function.

Figure 10:
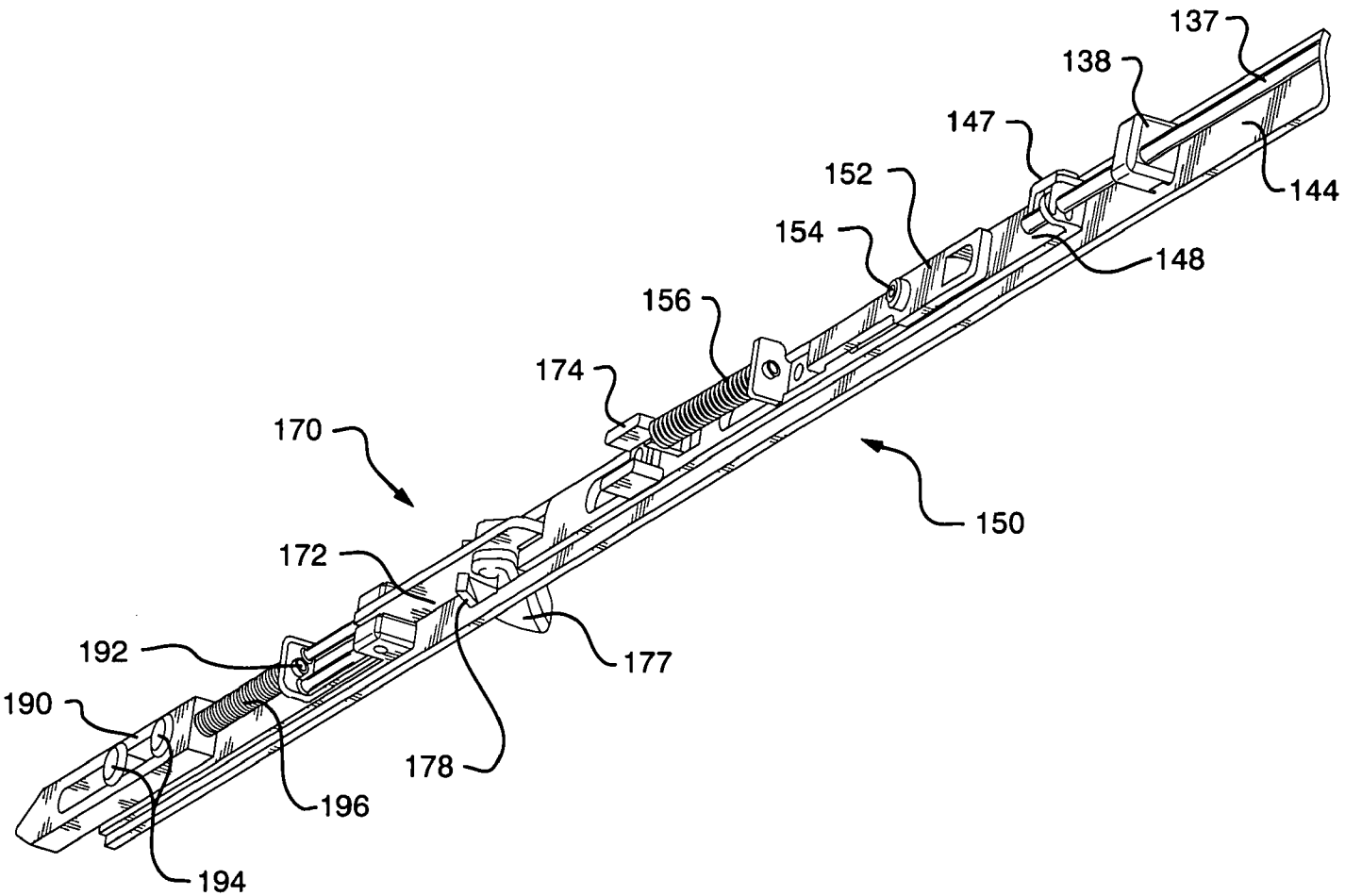
FIG. 10 is a rear perspective view of a remote portion of the first lock mechanism employing a tongue lock remote locking point.
Figure 12:
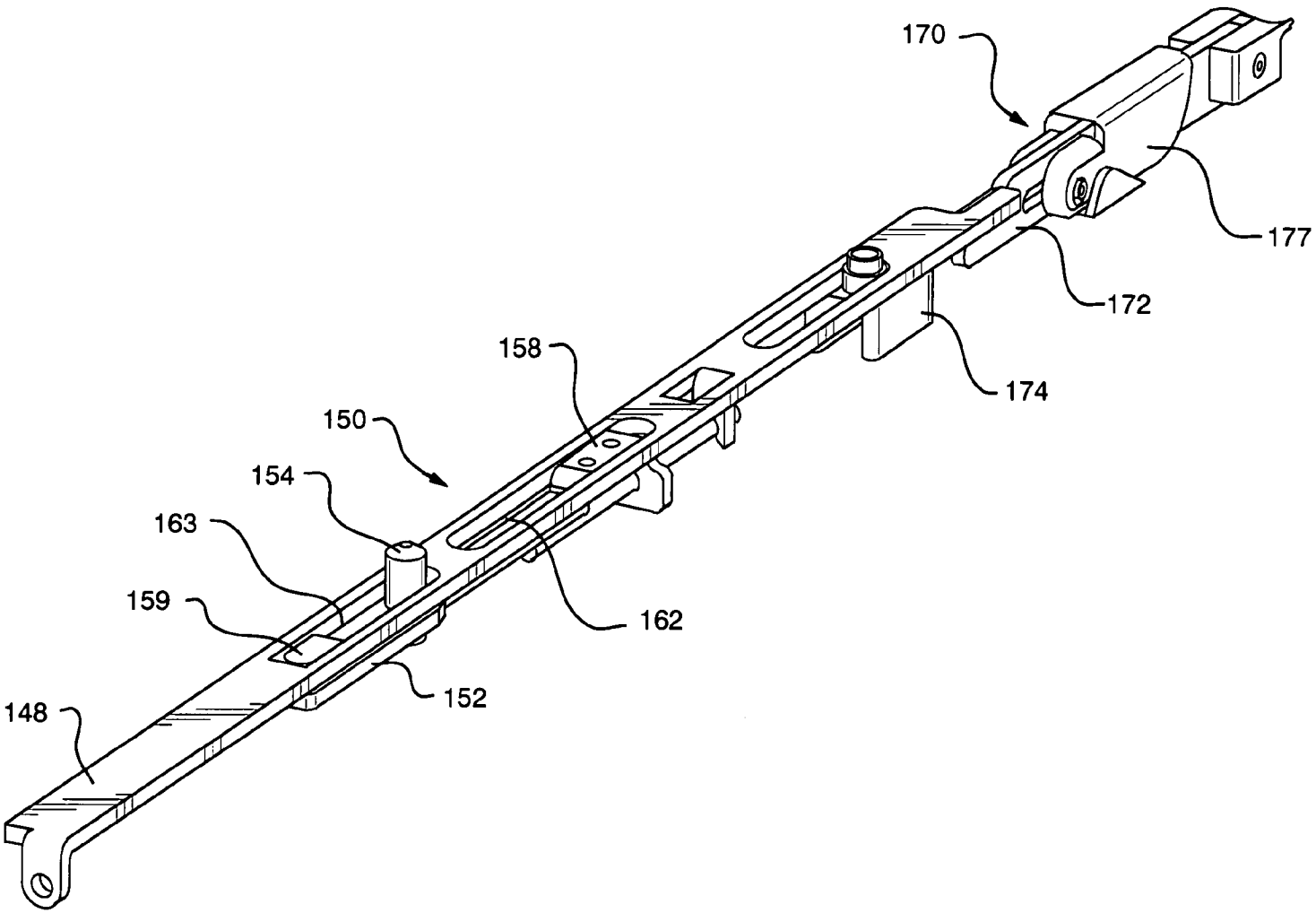
FIG. 12 is a frontal perspective view of a sensor-trigger mechanism of the first lock mechanism (faceplate and drive spring removed) in the armed position.
Figure 13A:
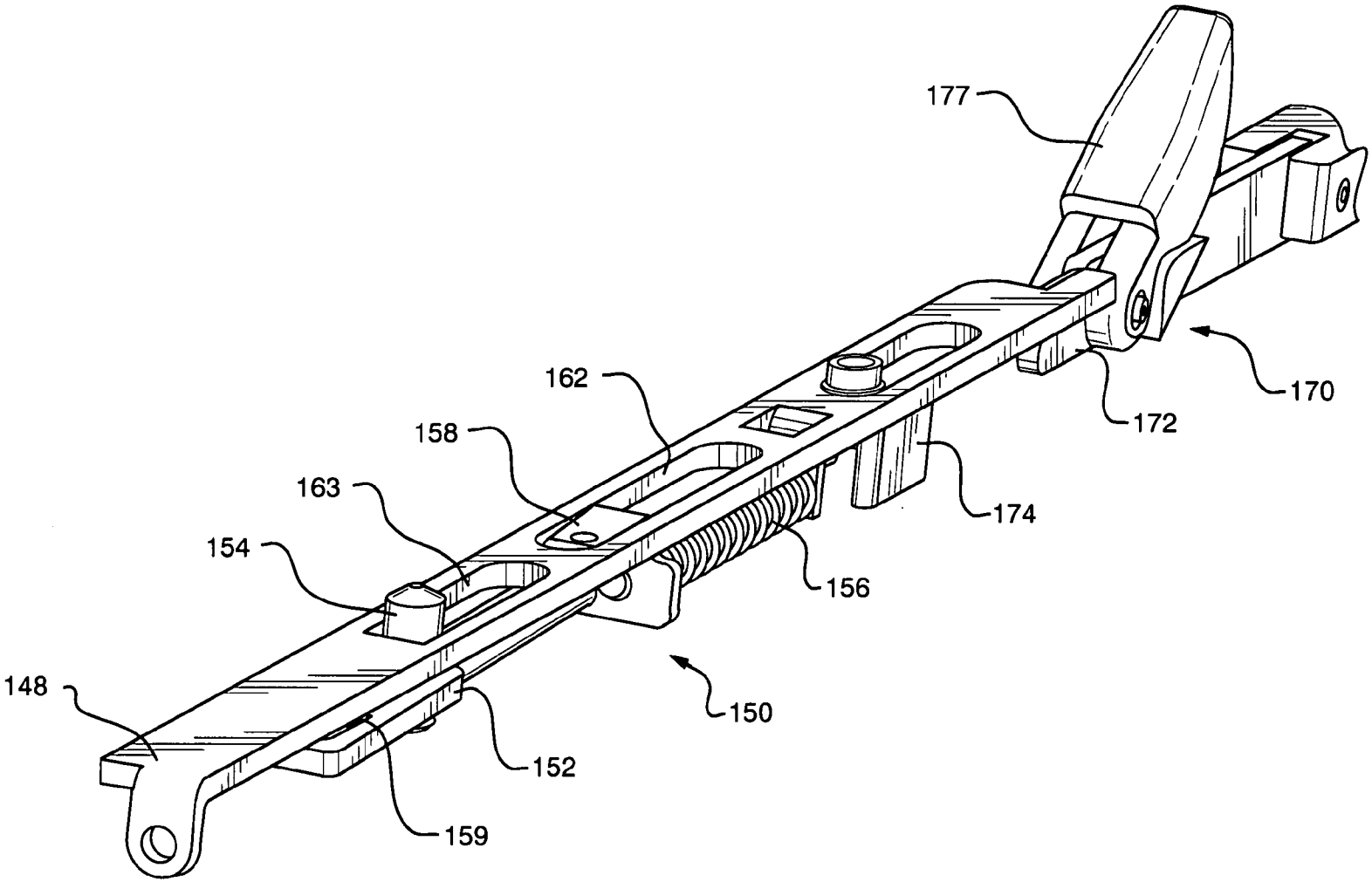
FIG. 13*a* is a frontal perspective view of a sensor-trigger mechanism of the first lock mechanism (faceplate removed) in the deployed position.
Figure 13B:
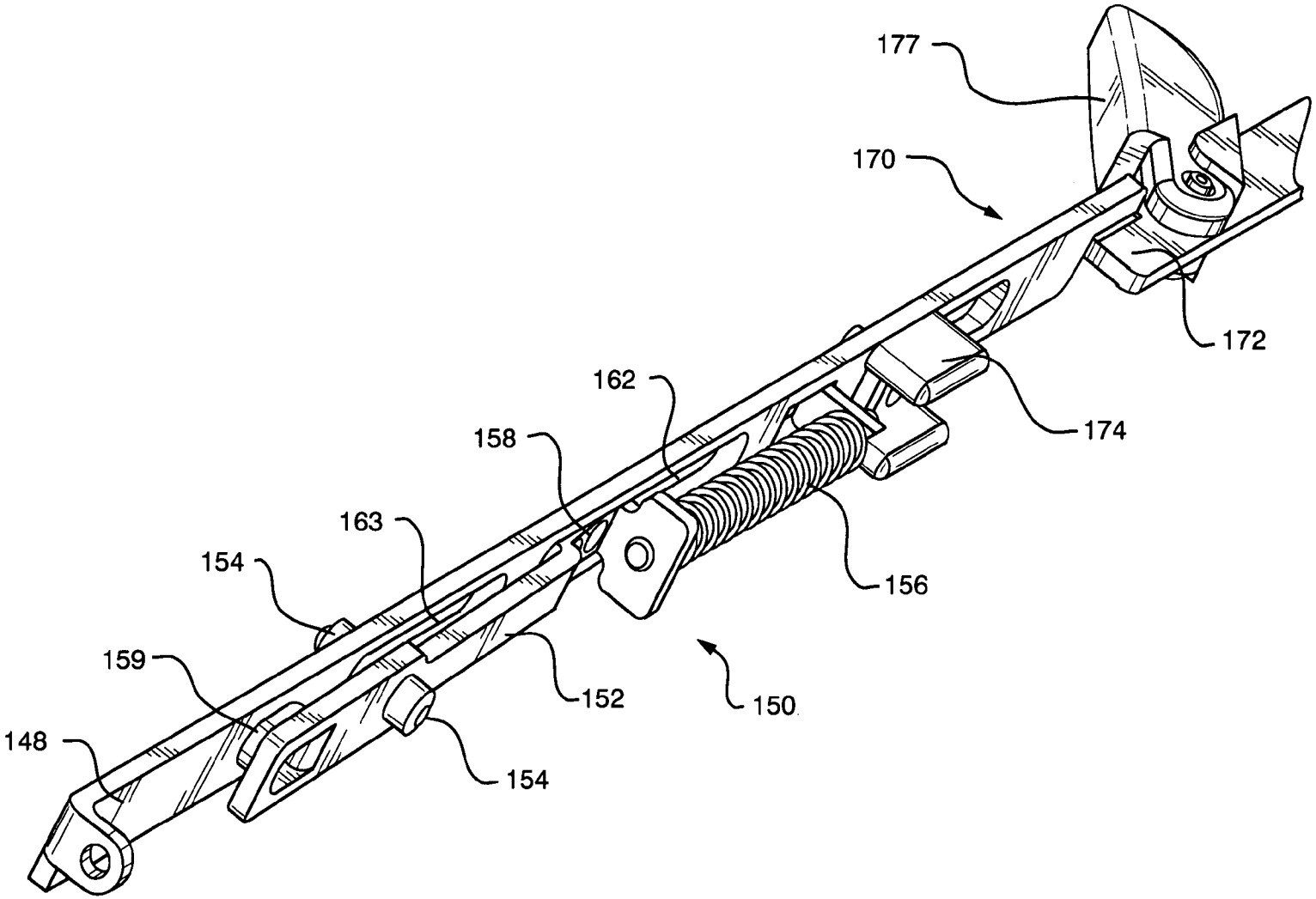
FIG. 13*b* is a rear perspective view of a sensor-trigger mechanism of the first lock mechanism (faceplate removed) in the deployed position.

Referring to FIG. 10, a close-up of one remote section of the first lock mechanism 100 is shown—the opposite remote section of the mechanism is identical. It should be noted that although two remote sections are depicted in the current embodiment of the invention, at least one remote section or a plurality of remote sections can be utilized. A stand-off 174 provides enough clearance space to allow the moving components of the first lock mechanism to operate uninhibited. In this figure, the remote locking member 160 (FIG. 1) is a tongue version employing a tongue lock 170. The tongue lock 170 comprises a tongue 177 rotatably attached to a tongue slide 172, which slidably engages the primary remote slide 148 as noted previously. Movement of the primary remote slide in a forward (away from the first cassette 102) direction causes the tongue slide 172 to slide forward, which in turn causes the tongue 177 to push against a tongue guide 178 and rotate outward to the deployed position (here partial deployment is shown). Forward movement of the tongue slide 172 also causes the shootbolt 190 to deploy. The shootbolt 190 is positioned via a set of guide pins 194 and is actuated by a drive rod 192, which is in mechanical communication with the tongue slide 172. Coiled around the drive rod 192 is a drive spring 196, which spring loads the shootbolt 190. Also shown in FIG. 10 is a view of the sensor-trigger mechanism 150. The sensor trigger-mechanism 150 comprises a sensor slide 152, at least one sensor trigger 154 mechanically attached to said sensor slide 152 and a sensor-trigger drive spring 156 which is coupled to said sensor slide 152, making the sensor-trigger mechanism 150 spring-loaded. The sensor slide 152 is in mechanical communication with the primary remote slide 148. FIGS. 12,13*a–b* provide a more detailed look at one of the sensor trigger mechanisms 150, the other 151 being identical. The sensor-trigger mechanism 150 is movable between two distinct positions which function in concert with the locking function of the multipoint lock 10. In FIG. 12, the sensor-trigger mechanism 150 is shown in the armed position. In this position, a slide hook 159, protruding off of the sensor slide 152, is positioned within a hook slot 163 formed in the primary remote slide 148. The remote sensor trigger 154 is also positioned within said hook slot 163. Another feature of the sensor slide 152 is a guide hook 158 positioned within the confines of a guide slot 162 formed in the primary remote slide 148; the guide hook 158 and guide slot 162 combination prevents the sensor slide 152 from sliding off-line. While the sensor-trigger mechanism 150 is in the armed position, the corresponding remote locking point, in this case a tongue lock 170, is also in the armed or primary remote locking point retracted position as shown. Focusing on FIGS. 13*a–b*, the sensor-trigger mechanism 150 and corresponding primary remote locking point 160 are shown in the unarmed and primary remote locking point deployed positions respectively. In this case the slide hook 159 is removed from the hook slot 163, which causes the sensor slide 152 to slide toward the first cassette 102 and the primary remote slide 148 to slide away from the first cassette 102, which in turn deploys the primary remote locking points 160 and 190 (not shown).

Figure 11:
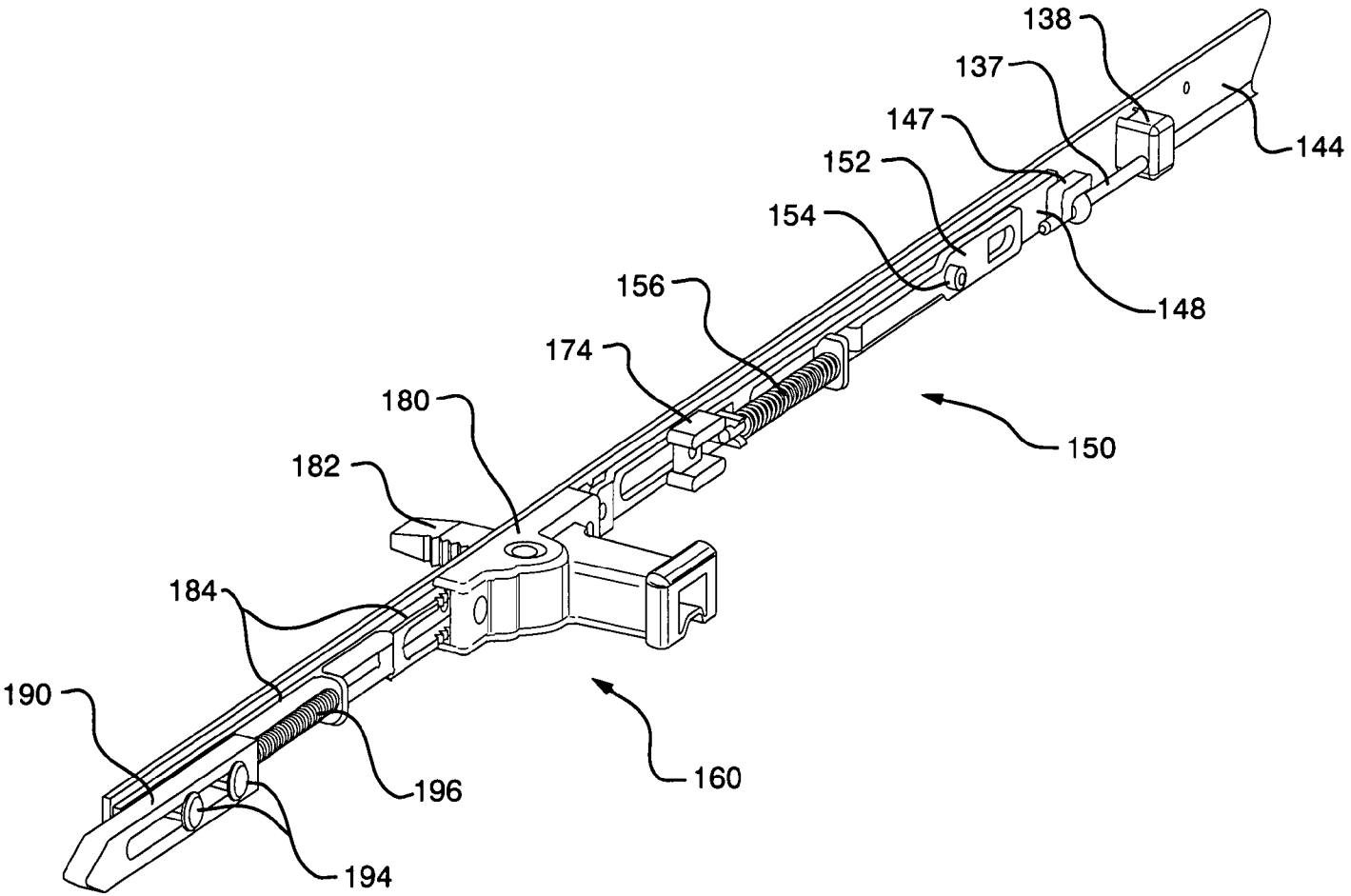
FIG. 11 is a rear perspective view of a remote portion of the first lock mechanism employing a deadbolt lock remote locking point.
Figure 14:
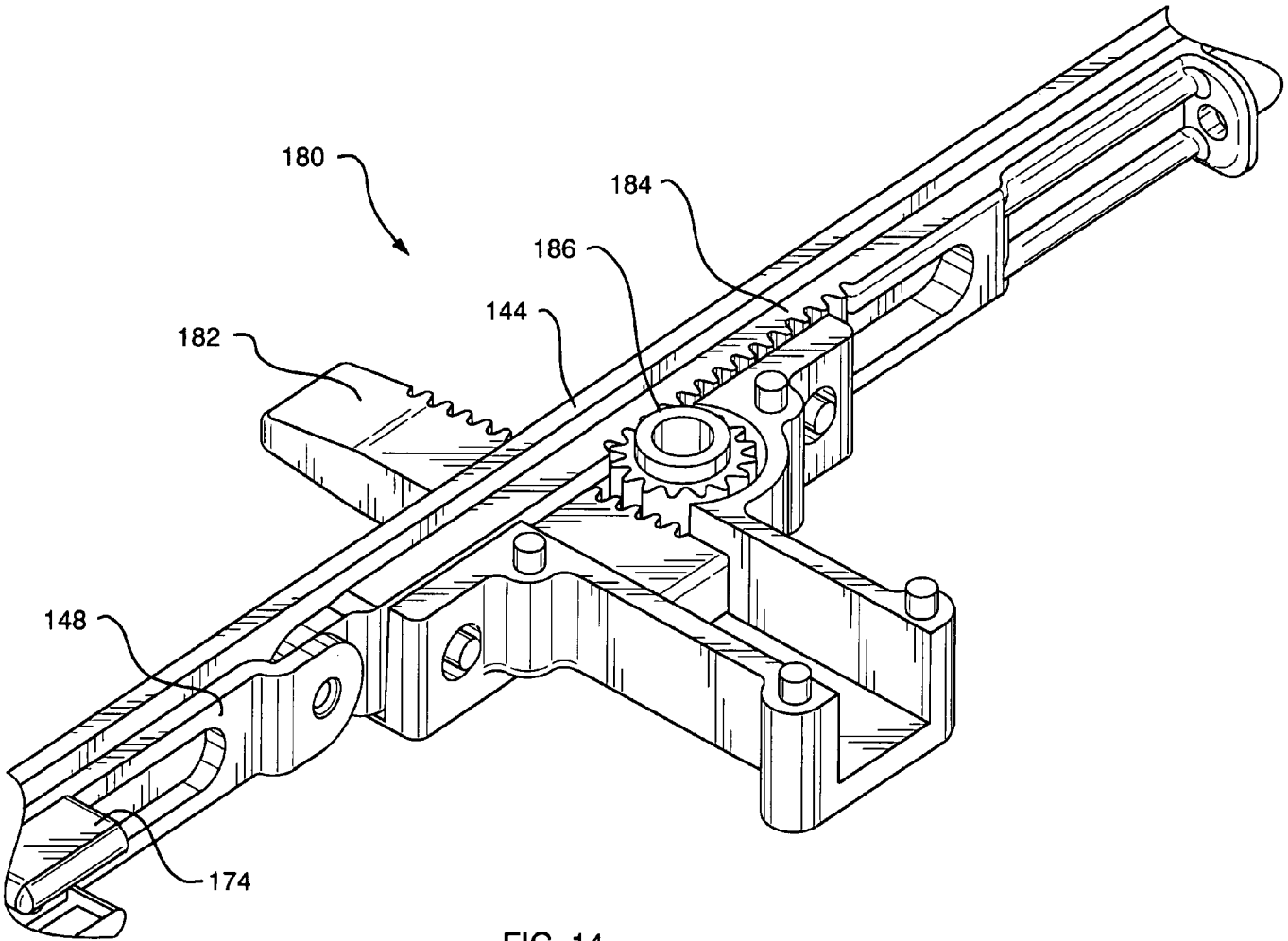
FIG. 14 is a perspective view of a remote deadbolt lock with cover removed.

Referring to FIGS. 11 and 14, a close-up view of the same remote section of the first lock mechanism 100 of FIG. 10 is shown, but in this embodiment of the invention, the remote locking point is a deadbolt lock 180 rather than the tongue lock 170 shown in FIG. 10. In this embodiment, the primary remote sensor slide 148 is mechanically coupled to a secondary remote slide 184. The secondary remote slide 184 comprises a set of teeth to engage a remote deadbolt pinion 186 (FIG. 14), which in turn engages a remote deadbolt 186, thereby allowing the remote deadbolt to reciprocate between a retracted (not shown) and deployed condition. Aside from employing a remote deadbolt lock in place of a remote tongue lock, this embodiment operates in the same manner as described above.

Figure 15:
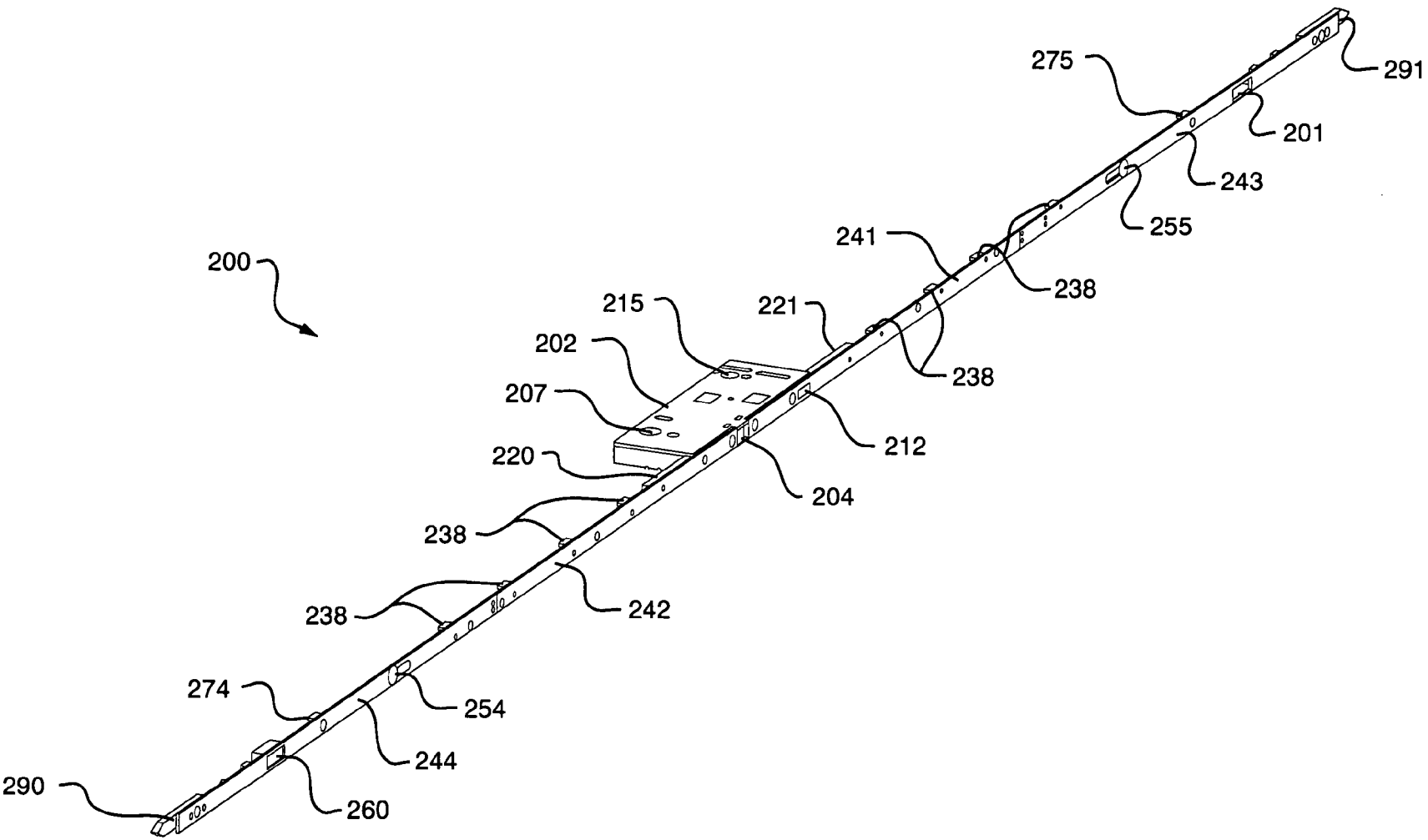
FIG. 15 is a frontal perspective view of the second lock mechanism.
Figure 16:
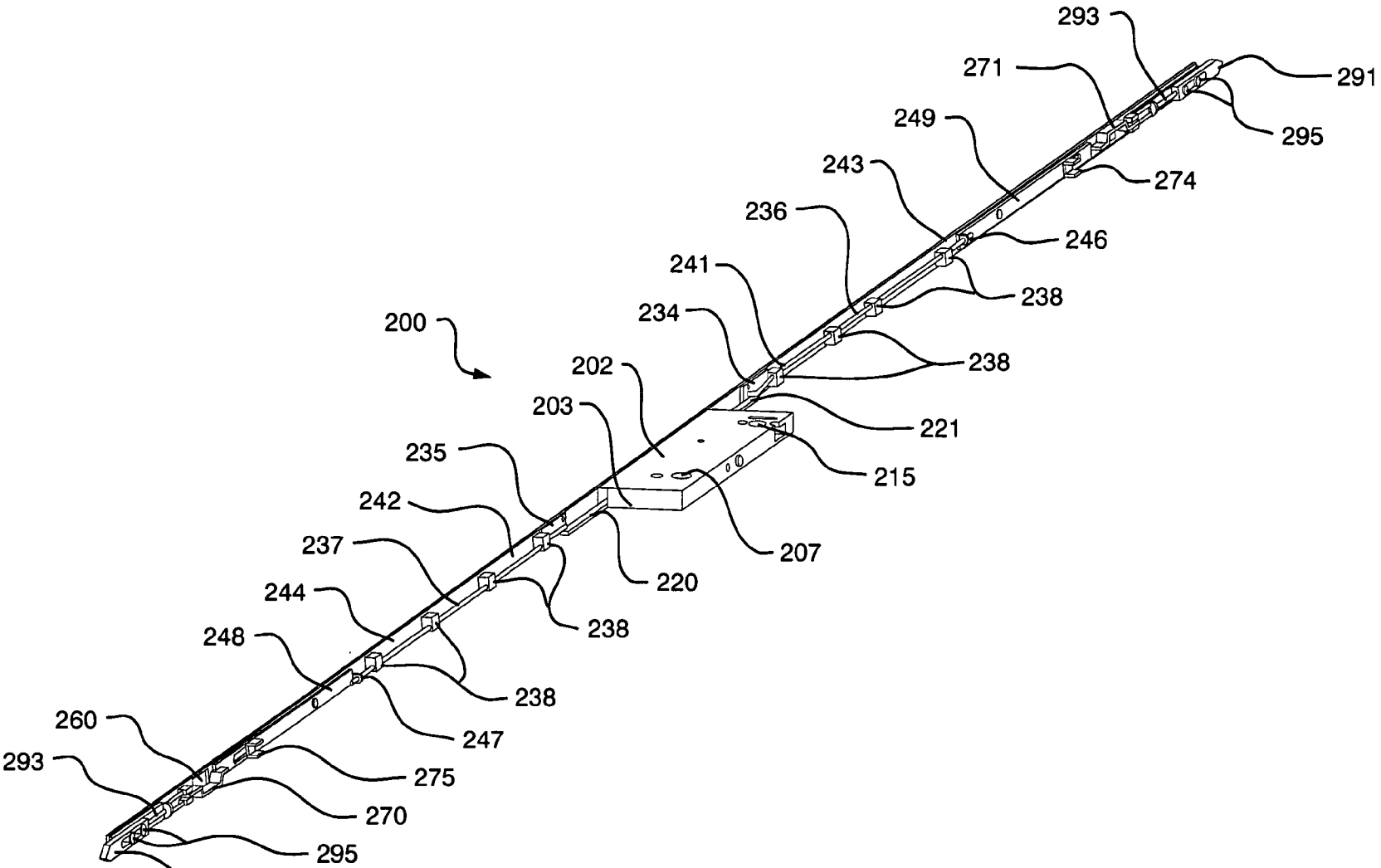
FIG. 16 is a rear perspective view of the second lock mechanism of FIG. 15.

Having thus described the first lock mechanism 100 of the multipoint lock system, attention will now be drawn to the co-acting second lock mechanism 200. Referring to FIGS. 15–16, the second lock mechanism 200 is shown. The second lock mechanism 200 comprises a second cassette 202, which operates the mechanism. The second cassette 202 is generally located in a central location upon the second lock mechanism 200, but can be located at any feasible location. The second cassette 202 is mounted to a fifth faceplate 241 and a sixth faceplate 242 via mechanical fasteners such as screws. Attached to the fifth faceplate 241 and the sixth faceplate 242 via mechanical connections and or linkages are a seventh faceplate 243 and an eighth faceplate 244 respectively. The above-mentioned faceplates 241,242,243,244 are mounted flush to the inactive door 40 via mechanical fasteners, such as screws, and provide a support base for the second lock mechanism components described below. A pair of remote receiver windows 260 and 261, which act to receive the primary remote locking points 160 and 161 of the first lock mechanism 100, are cut into the eighth 244 and seventh 243 faceplates respectively. It should be noted that although four faceplates are used in the embodiment described herein, any desirable number of faceplates from one to a plurality can be employed provided that proper rigidity is maintained to support the mechanism and prevent the inactive door from warping.

Extending outward from the cassette 202 in opposite directions is a set of secondary remote actuators 220 and 221. The secondary remote actuators 220 and 221 slidably engage remote actuator connectors 234 and 235 respectively. Attached to the remote actuator connectors 234 and 235 are actuator rods 236 and 237 respectively. The actuator rods 236 and 237 are each guided and supported by a series of rod guides 238. At the ends opposite to where the actuator rods 236 and 237 attach to the remote actuator connectors 234 and 235, the actuator rods 236 and 237 are connected to remote slides 248 and 249 via rod connectors 246 and 247 respectively. Attached to the remote slides 248 and 249 are a pair of sensor pads 254 and 255 respectively, which are adjustable to make contact with respective remote sensor triggers 154 and 155 of the first lock mechanism 100. The sensor pads 254, 255 pass through slots cut into the seventh and eighth faceplates 243,244, thereby allowing the sensor pads 254,255 to slide freely in conjunction with the movement of the remote slides 249 and 249. Also attached to the remote slides are a set of remote receiver window blockers 270 and 271, which block remote receiver windows 260 and 261 from receiving the corresponding remote locking points 160 and 161 (see FIG. 2), more specifically, tongue locks 170 and 171 if tongue locks are employed (FIGS. 3–4) or deadbolt locks 180 and 181 if deadbolt locks are employed (FIGS. 5–6). Finally, the first remote receiver window blockers 270 and 271 are respectively linked to a pair of secondary remote locking points, typically shootbolts 290 and 291, which engage either the head or sill of the inactive door 40 depending on the arrangement of the second lock mechanism 200.

Figure 19A:
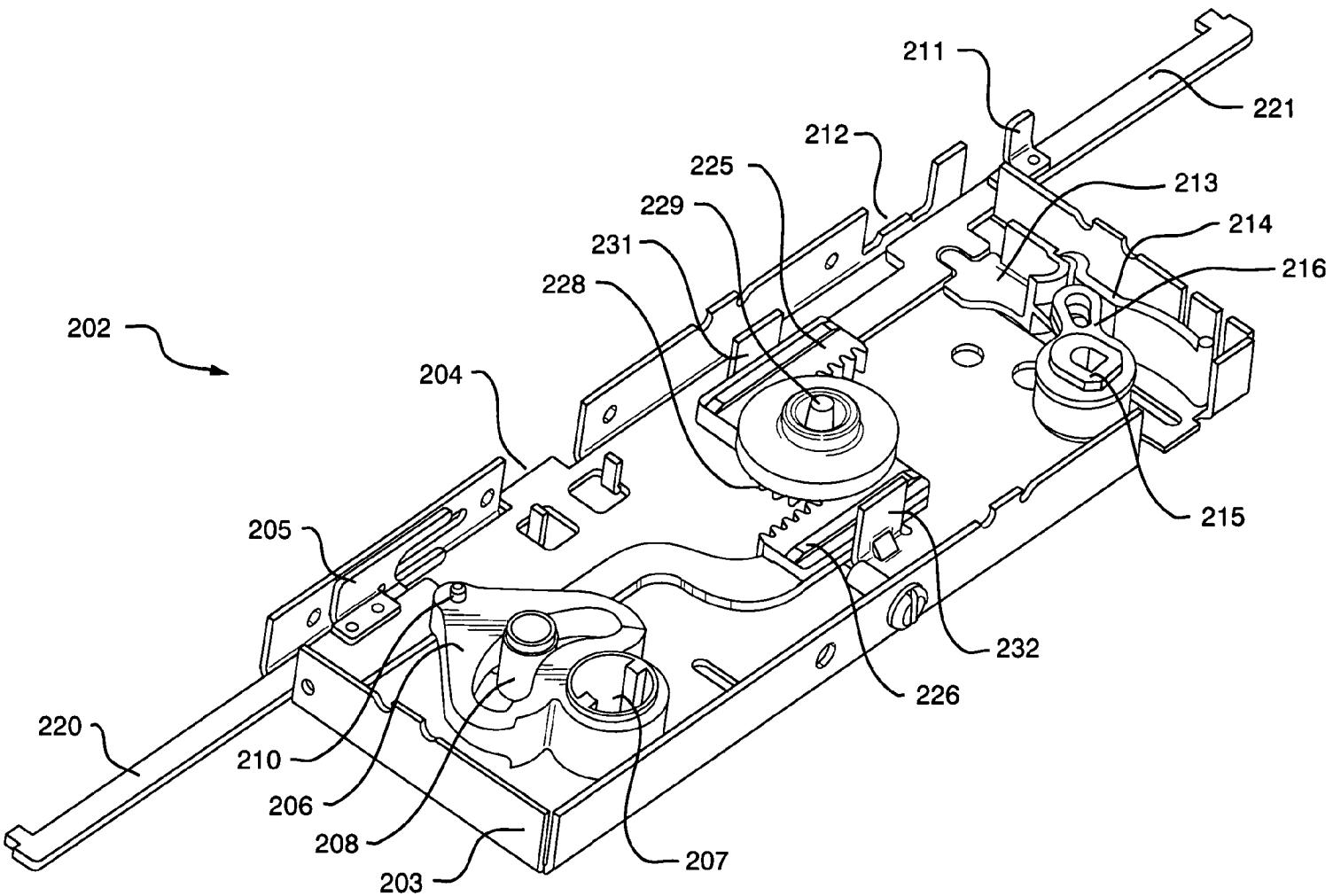
FIG. 19*a* is an elevated perspective view of the second cassette of the second lock mechanism with cover removed, first and second receiver windows open, and the remote actuator lock engaged.
Figure 20A:
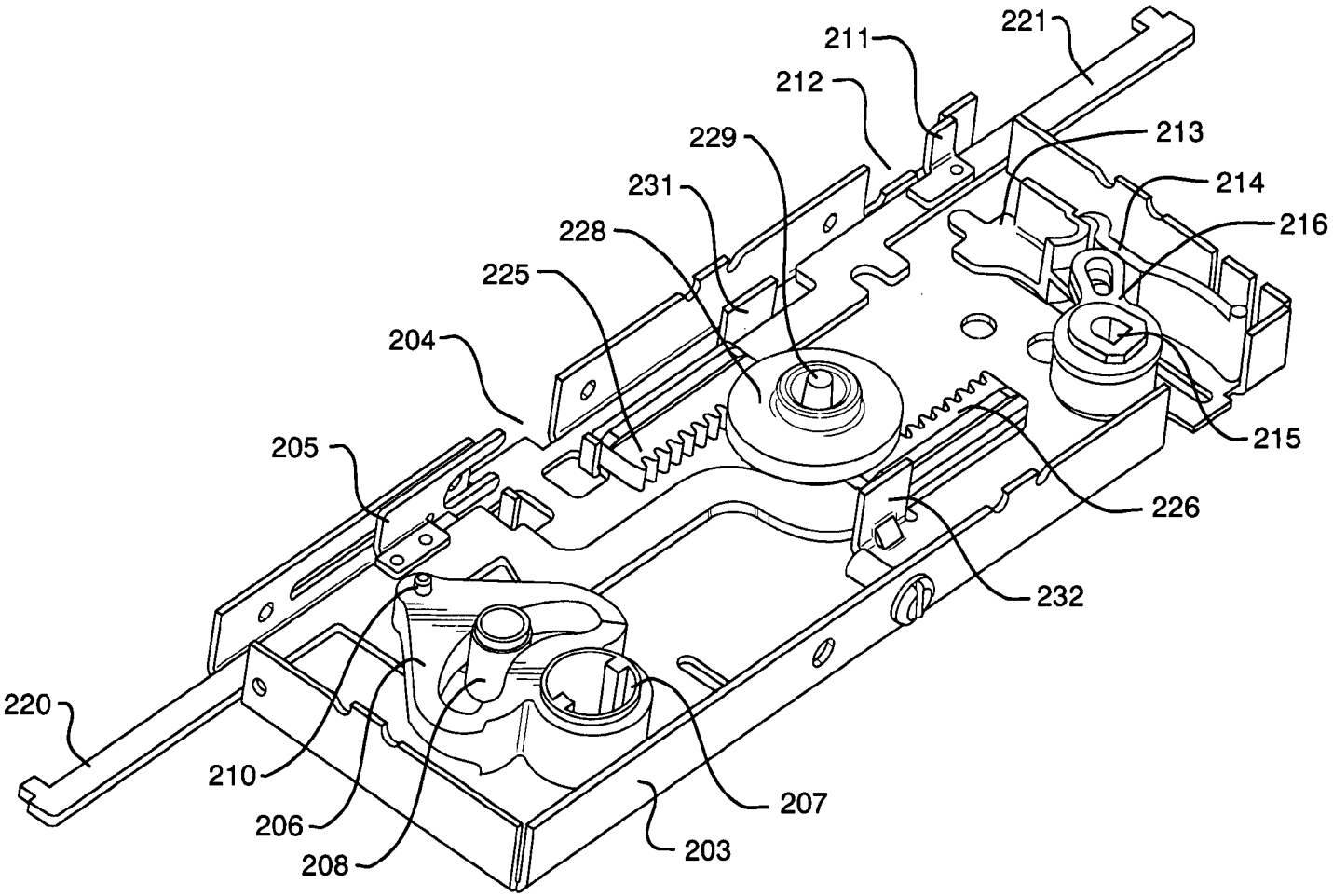
FIG. 20*a* is an elevated perspective view of the second cassette of the second lock mechanism with cover removed, first and second receiver windows blocked, and the remote actuator lock disengaged.

Referring now to FIGS. 19*a* and 20*a*, the cassette 202 of the inactive door lock mechanism 200 is shown in more detail by removing its cover to expose its internal components. In general, the cassette 202 itself comprises a typical rectangular shaped housing 203, which may be conveniently and economically constructed from cast metal or molded plastic components or the like. The housing 203 defines a first receiver window 204 for receiving the latching member, typically a latchbolt 104, and a second receiver window 212 for receiving the locking member, typically a deadbolt 112. The cassette 202 houses a second primary actuator 206, which comprises an actuator hub 207 for receiving the third input device 42, typically a handle or lever, and lock actuator assembly, which comprises a lock actuator 216, a secondary remote actuator lock 213, and a remote actuator lock hub 215 for receiving a fourth input device 44, typically a knob or thumbturn.

Focusing on the second primary actuator 206, a clearance tube 208 is positioned in a central slot within the second primary actuator 206 to guide the actuator 206 and prevent the housing from interfering with the moving parts inside the cassette 202. At the tip of the second primary actuator 206 is positioned a remote actuator drive pin 210, which connects the second primary actuator 206 to the secondary remote actuators 220 and 221 and drives them via a rack and pinion linkage described below. Focusing on the lock actuator 216, a connector pin (not shown) is provided to mechanically couple the lock actuator 216 to a retractable secondary remote actuator lock 213. The retractable remote lock 213 locks the remote actuators 220 and 221 into position, preventing them from moving in one direction, but allowing them to move in an opposite direction. To secure the secondary remote actuator lock 213 in the deployed position (FIG. 19*a*), a remote actuator lock spring 214 is used, which can be of the variety shown here, of the variety shown in FIG. 8 whereby a leaf-type spring 119 is employed, or of any other suitable spring variety.

In the central portion of the first cassette 102, the secondary remote actuators 220 and 221 are linked via a rack and pinion system comprising: a pinion 228 rotatably supported and centered about a pinion axel 229, and a pair of remote racks 225 and 226, which engage said pinion 228 in a typical rack and pinion manner. The remote racks 225 and 226 are mechanically attached to the secondary remote actuators 221 and 220 respectively. To keep the remote actuators 220 and 221 from sliding out of position, a pair of remote actuator guides 231 and 232 attached to the second cassette housing 203 are utilized; said remotes actuator guides 231 and 232 align the secondary remote actuators 220 and 221 via direct contact. Attached to one of the secondary remote actuators 220 is a first receiver window blocker 205, which blocks the first receiver window 204 thereby preventing the latching member (latchbolt) 104, from entering and engaging the second lock mechanism 200. Attached to the other secondary remote actuator 221 is a second receiver window blocker 211, which blocks the second receiver window 212 thereby preventing the locking member (deadbolt) 112 from entering and engaging the second lock mechanism 200.

Figure 21A:
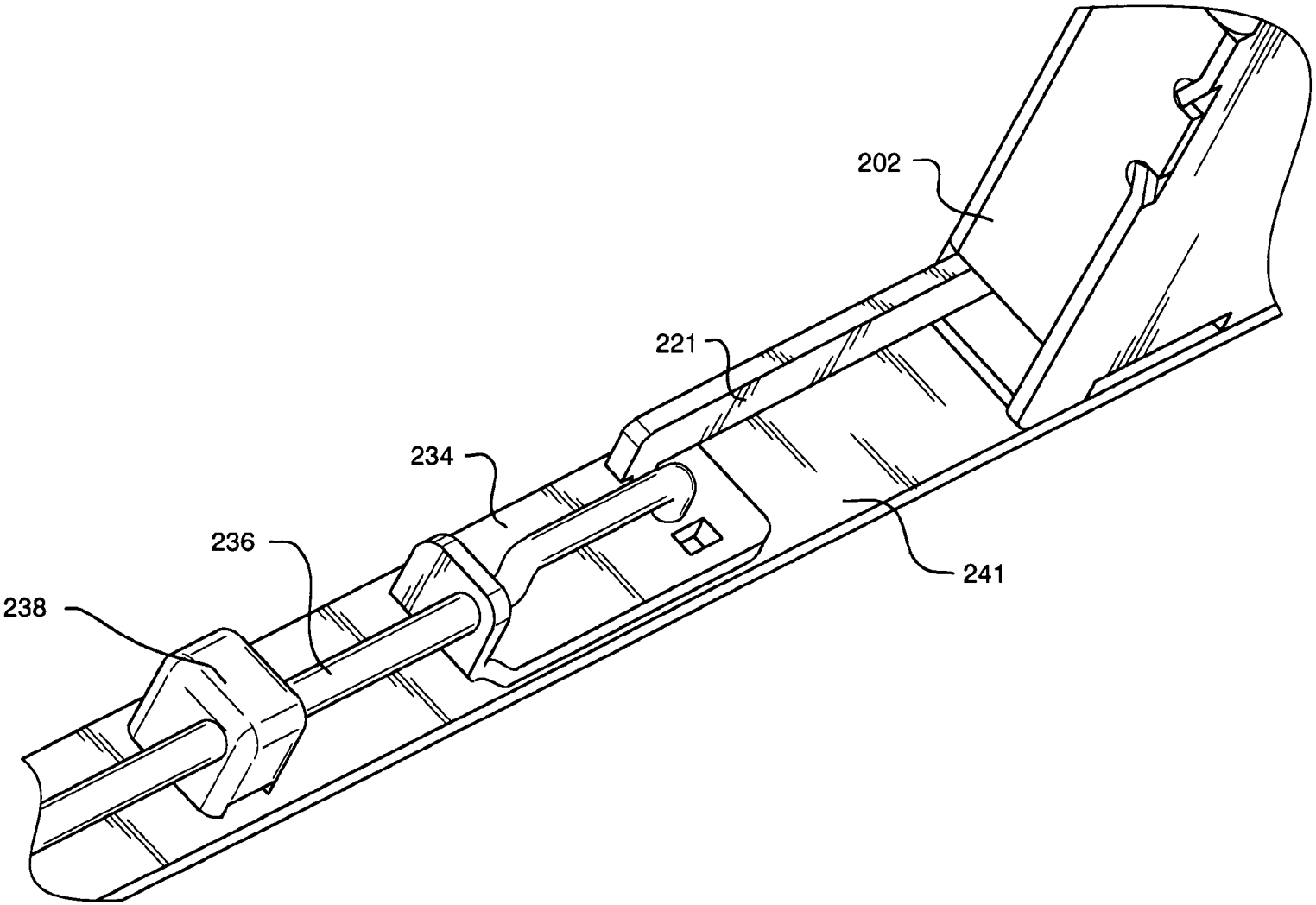
FIG. 21*a* is a perspective view of a remote actuator connector of the second lock mechanism showing the remote actuator in the door unlocked position.
Figure 21B:
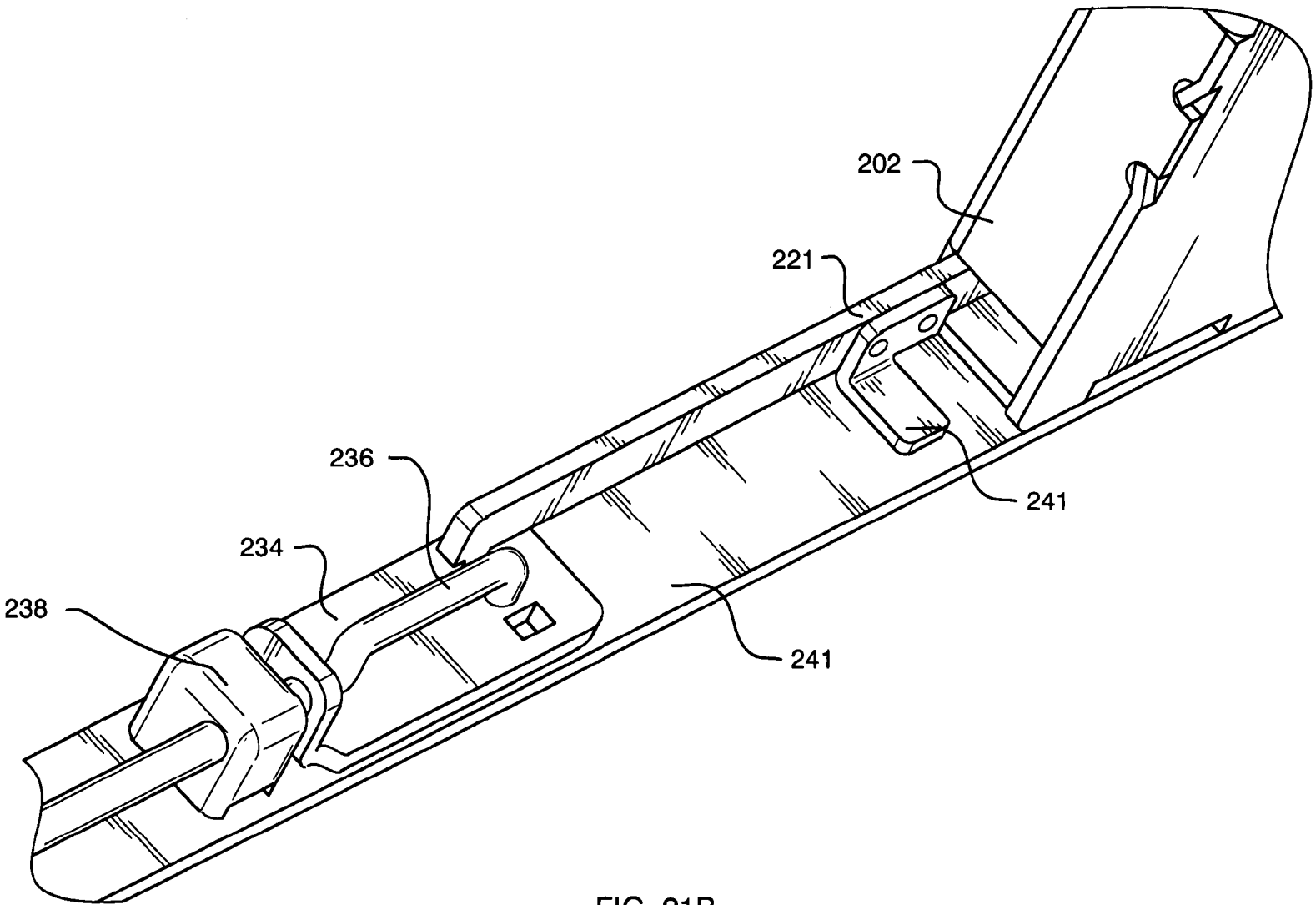
FIG. 21*b* is a perspective view of a remote actuator connector of the second lock mechanism showing the remote actuator in the door locked position.

Drawing attention to FIGS. 21*a*–21*b*, more detailed views of the positions of the remote actuators 220 and 221 are shown with respect to the various modes of operation of the second lock mechanism 200. It should be noted that although the views depict remote actuator 221 only, the remote actuator 220 functions in the same manner. As shown, the remote actuator 221 engages the remote actuator connector 234 via an aperture cut into said remote actuator connector 234. Each slot has a far end (away from the first cassette 102) and a near end (opposite the far end). Remote actuator connector 234 slides in conjunction with any movement of the remote actuator 221, which ultimately coincides with the movement of the input device or handle 42. Movement of the remote actuator connector 234 moves the actuator rod 236, which positions the remote slide 249, sensor pad 255, remote window blocker 271 and secondary locking point (shootbolt) 291. FIG. 21*a* shows the position of the remote actuator 221 when the active door 30 and optionally the inactive door are in the door opened/unlocked condition, which is facilitated by a downward movement of the handle 42 (not shown). FIG. 21*b* shows the position of the remote actuator 221 when the active door 30 and optionally the inactive door are in the door closed/locked condition, which is facilitated by an upward movement of the handle 42 (not shown).

Figure 22A:
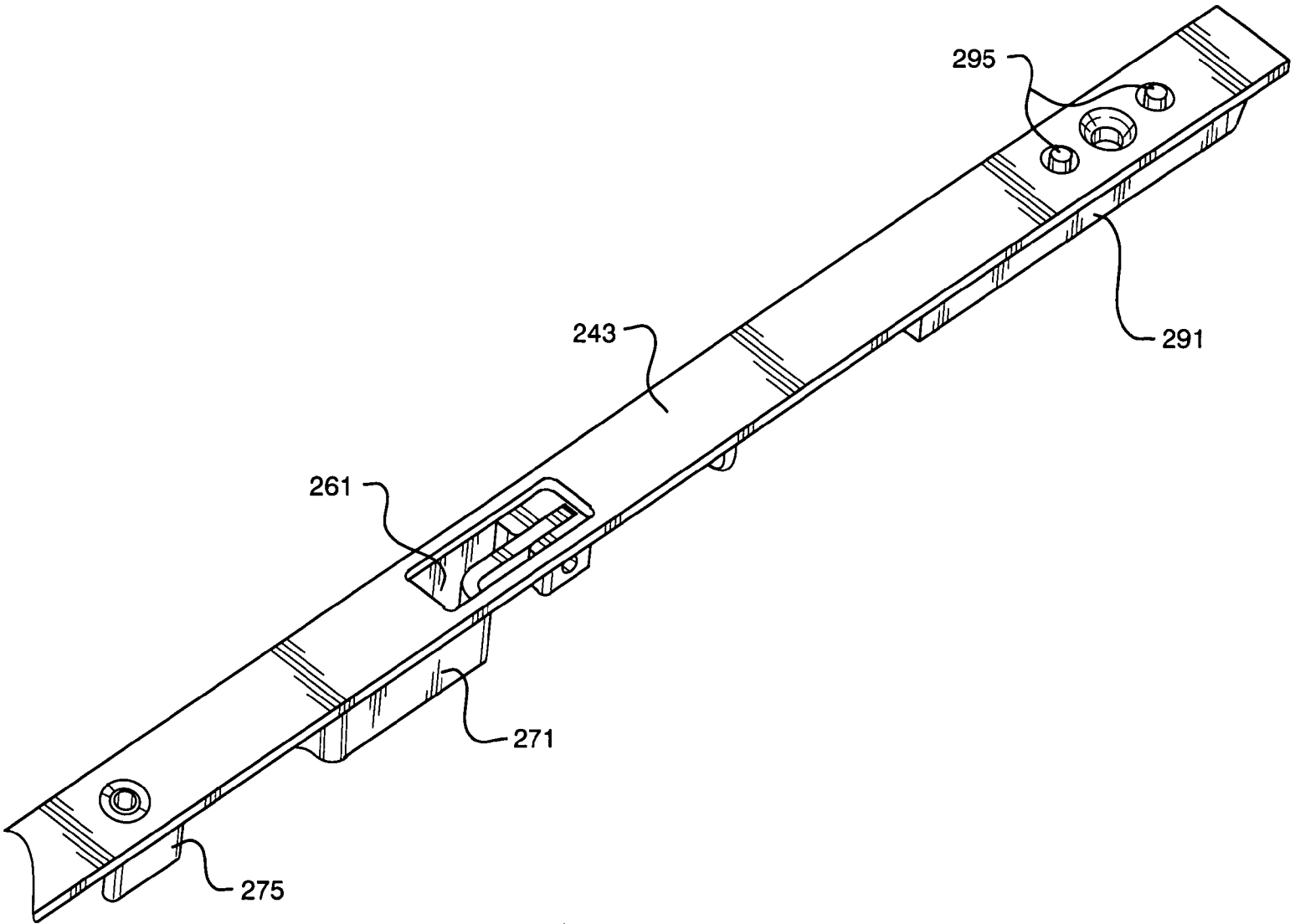
FIG. 22*a* is a frontal perspective view of a remote portion of the second lock mechanism with remote receiver window blocked and a secondary remote locking point retracted.
Figure 22B:
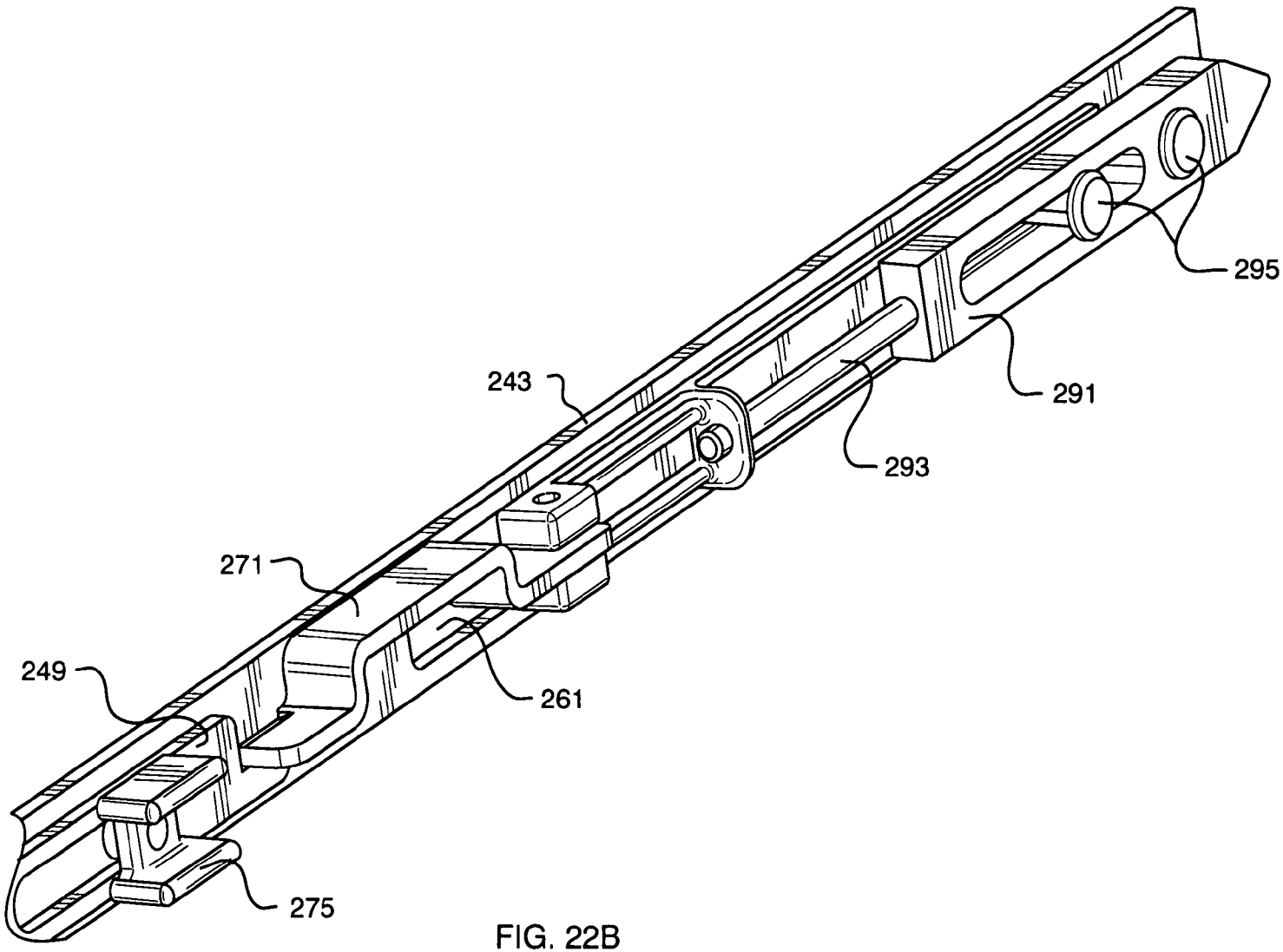
FIG. 22*b* is a rear perspective view of a remote portion of the second lock mechanism with remote receiver window blocked and a secondary remote locking point retracted.
Figure 23A:
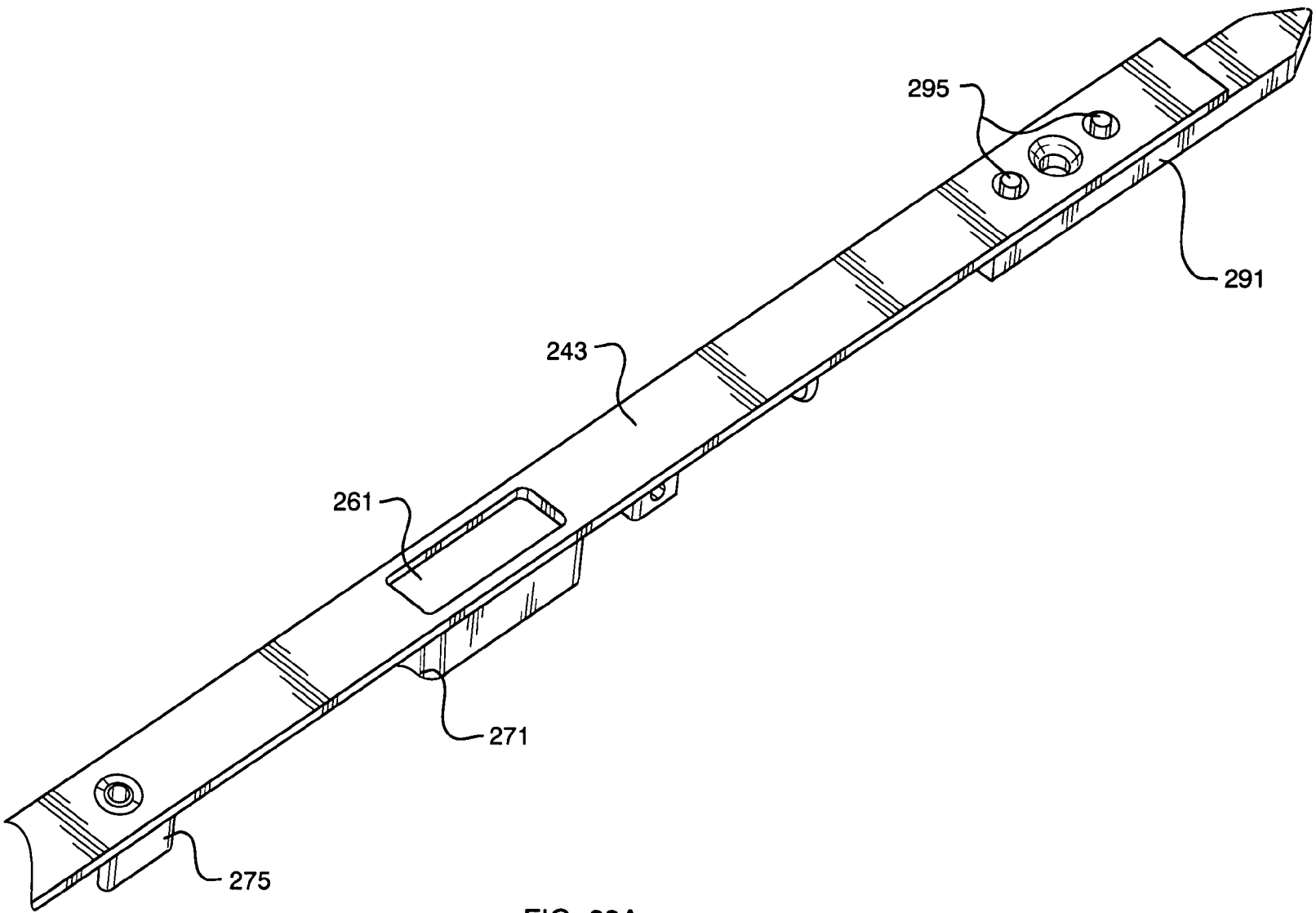
FIG. 23*a* is a frontal perspective view of a remote portion of the second lock mechanism with remote receiver window open and a secondary remote locking point deployed.
Figure 23B:
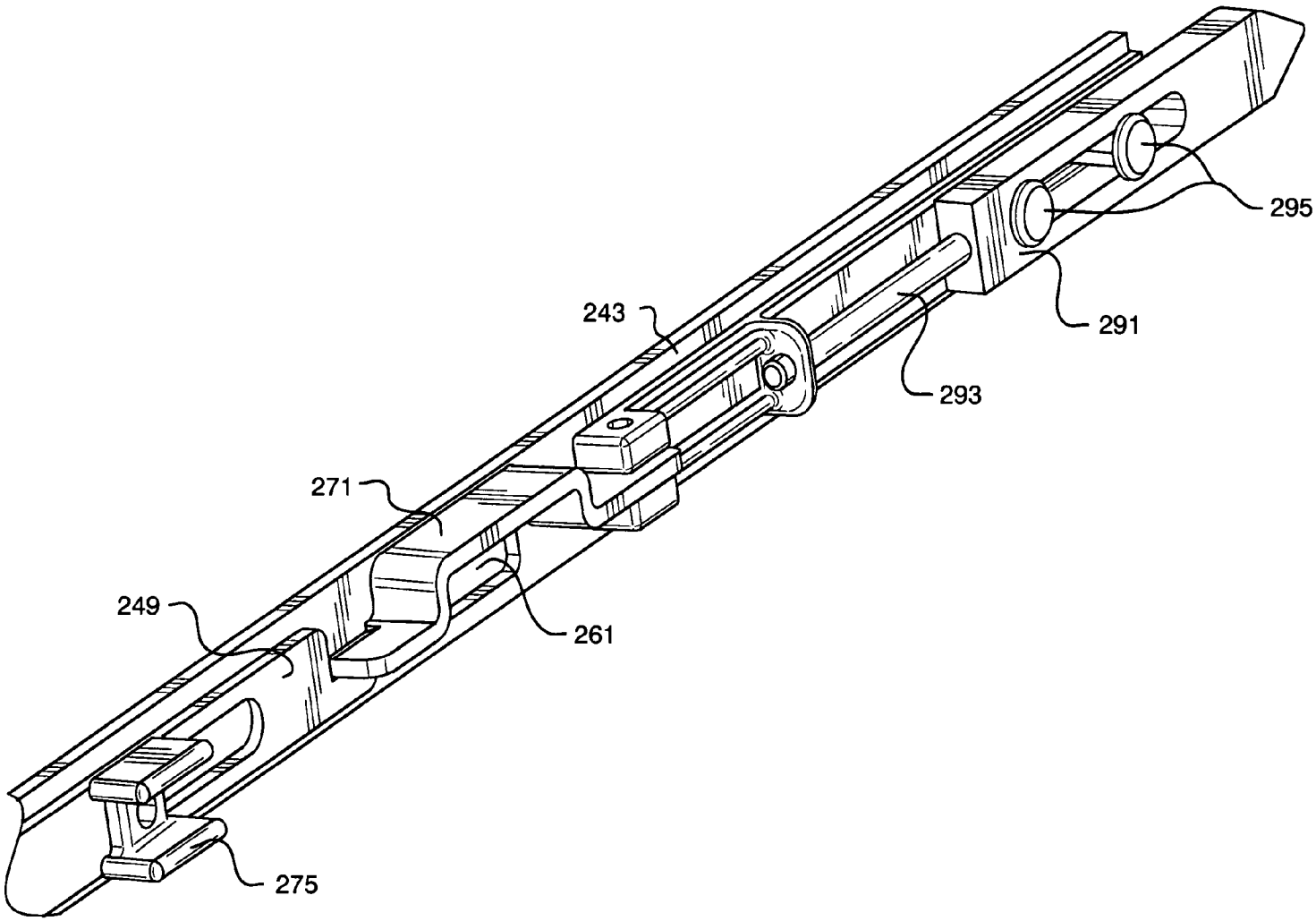
FIG. 23*b* is a rear perspective view of a remote portion of the second lock mechanism with remote receiver window open and a secondary remote locking point deployed.
Figure 24A:
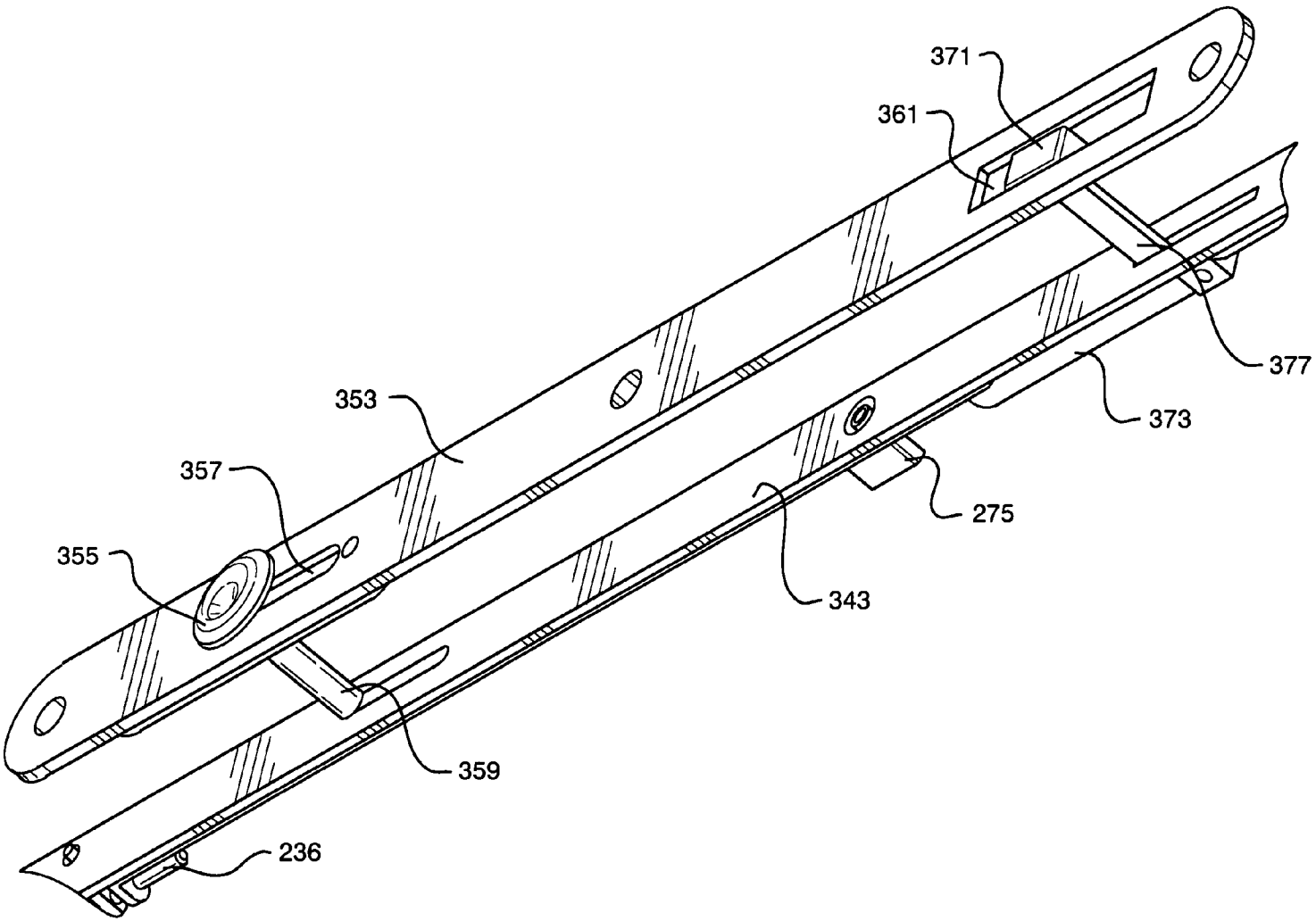
FIG. 24*a* is a frontal perspective view of a remote portion of the second lock mechanism astragal version showing the upper sensor pad and the second upper remote receiver window blocker in the door unlocked condition.
Figure 24B:
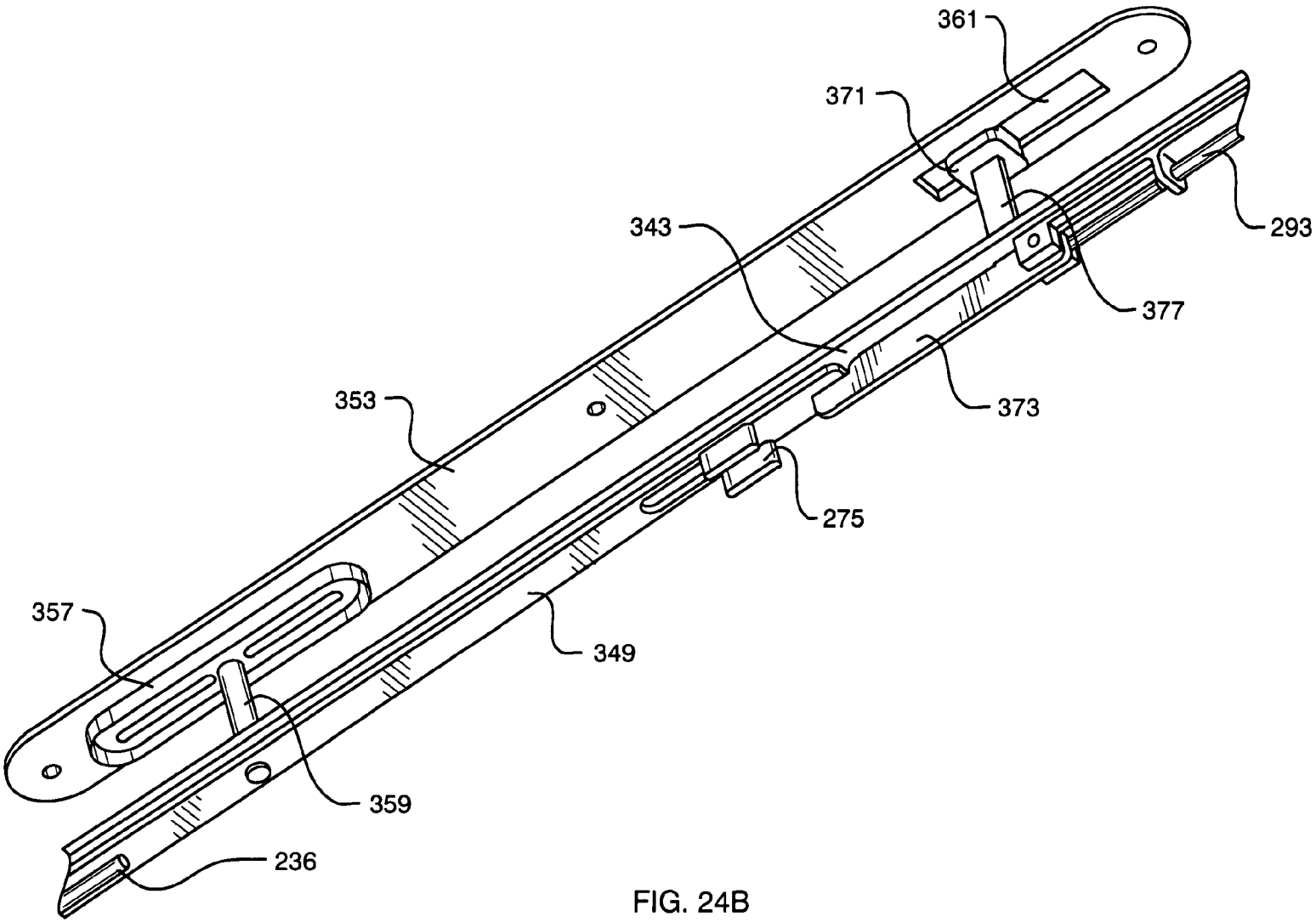
FIG. 24*b* is a rear perspective view of a remote portion of the second lock mechanism astragal version showing the upper sensor pad and the second upper remote receiver window blocker in the door unlocked condition.

Referring now to FIG. 22*a*, 22*b*, 23*a*, 23*b*, a close-up of one remote section of the second lock mechanism 200 is shown (the opposite end is identical). A stand-off 275 provides enough clearance space to allow the moving components of the second lock mechanism to operate uninhibited. FIGS. 23*a* and 23*b* depict the second lock mechanism 200 in the door closed/locked condition with the remote receiver window blocker 271 retracted, leaving the remote receiver window 261 open to receive the remote locking point 161 (FIG. 1) of the first lock mechanism 100 when a user chooses to close and lock the doors 30,40. Additionally, the secondary remote locking point, typically a shootbolt 291, is deployed in this condition. FIGS. 22*a* and 22*b* depict the second lock mechanism 200 in the door open/unlocked condition with the remote receiver window blocker 271 deployed leaving the remote receiver window 261 closed, thereby preventing the remote locking point 161 (FIG. 1) of the first lock mechanism 100 from entering and engaging the second lock mechanism 200; thus, accidental locking is averted. Additionally, the secondary locking point 291 is retracted in this condition.

Figure 17:
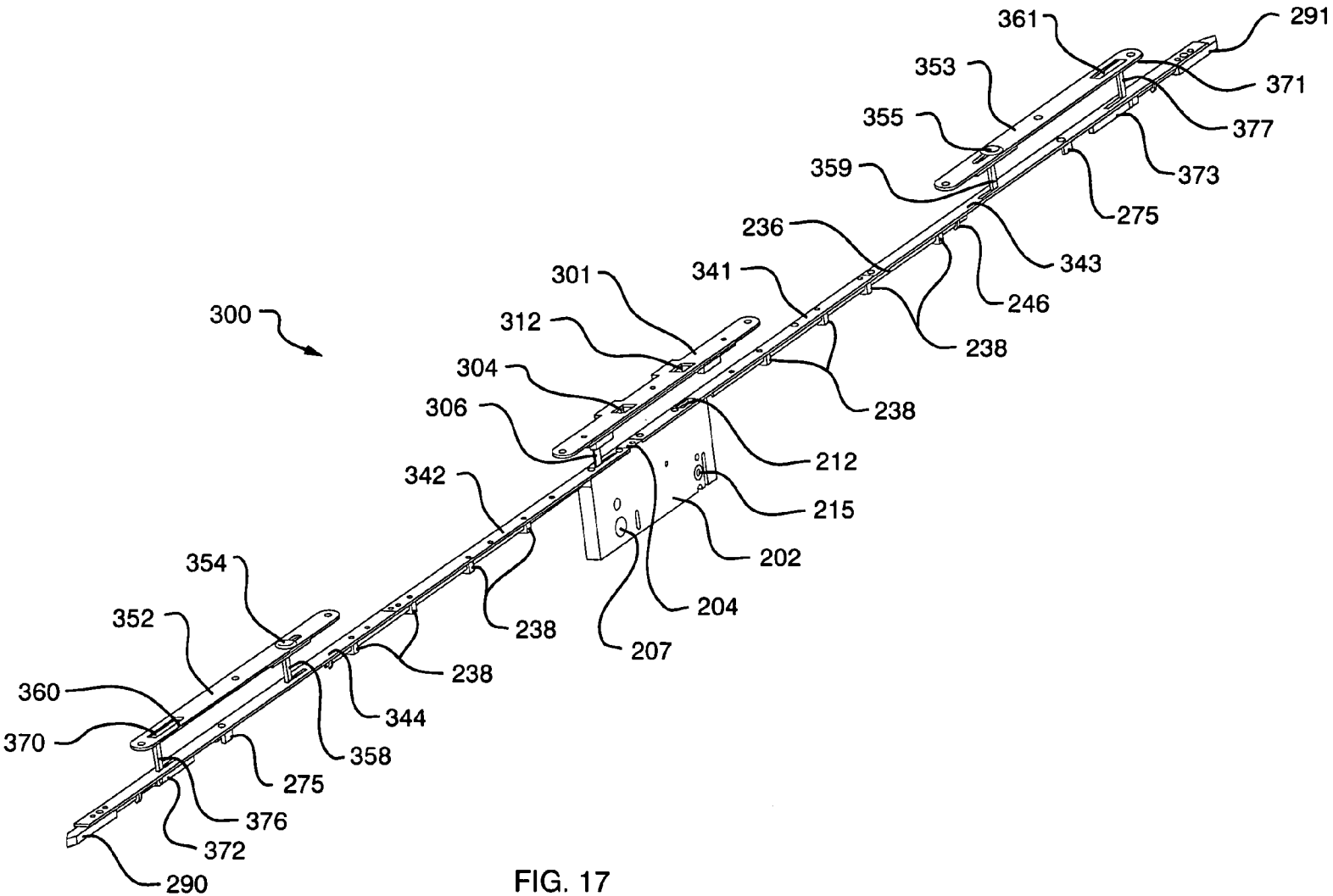
FIG. 17 is a frontal perspective view of the second lock mechanism astragal version.
Figure 18:
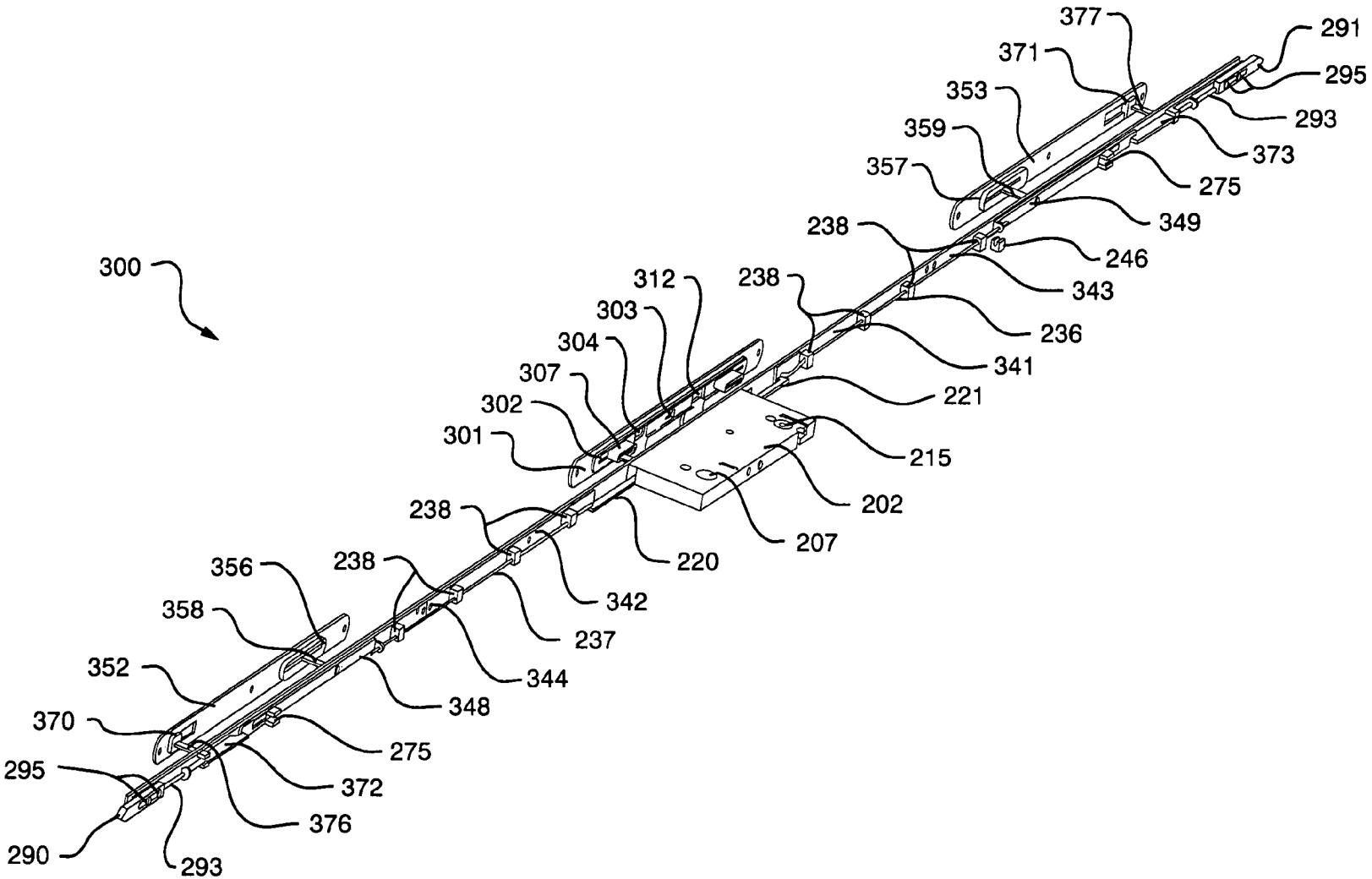
FIG. 18 is a rear perspective view of the second lock mechanism astragal version of FIG. 17.
Figure 19B:
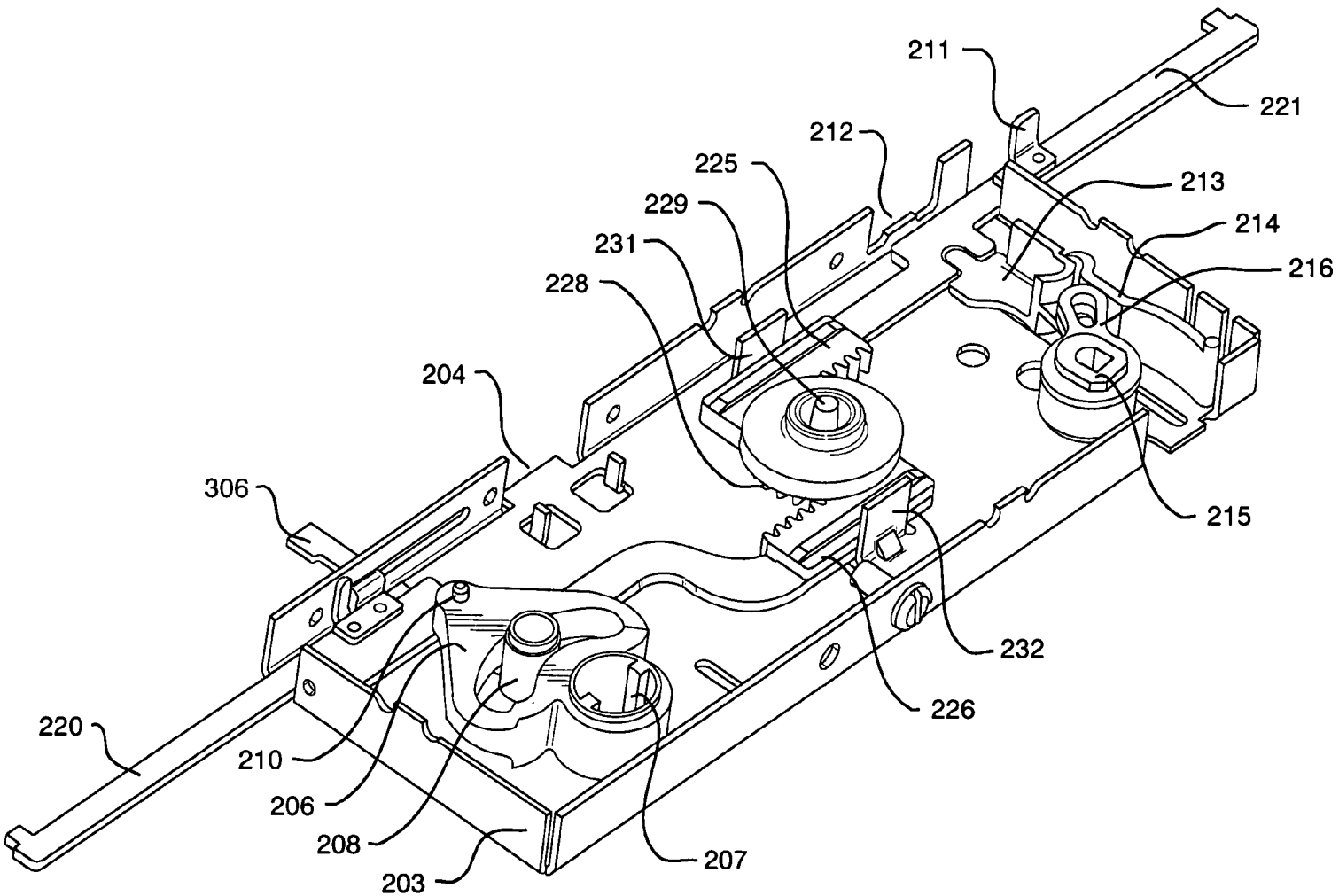
FIG. 19*b* is the astragal version of the second cassette of FIG. 19*a;*
Figure 20B:
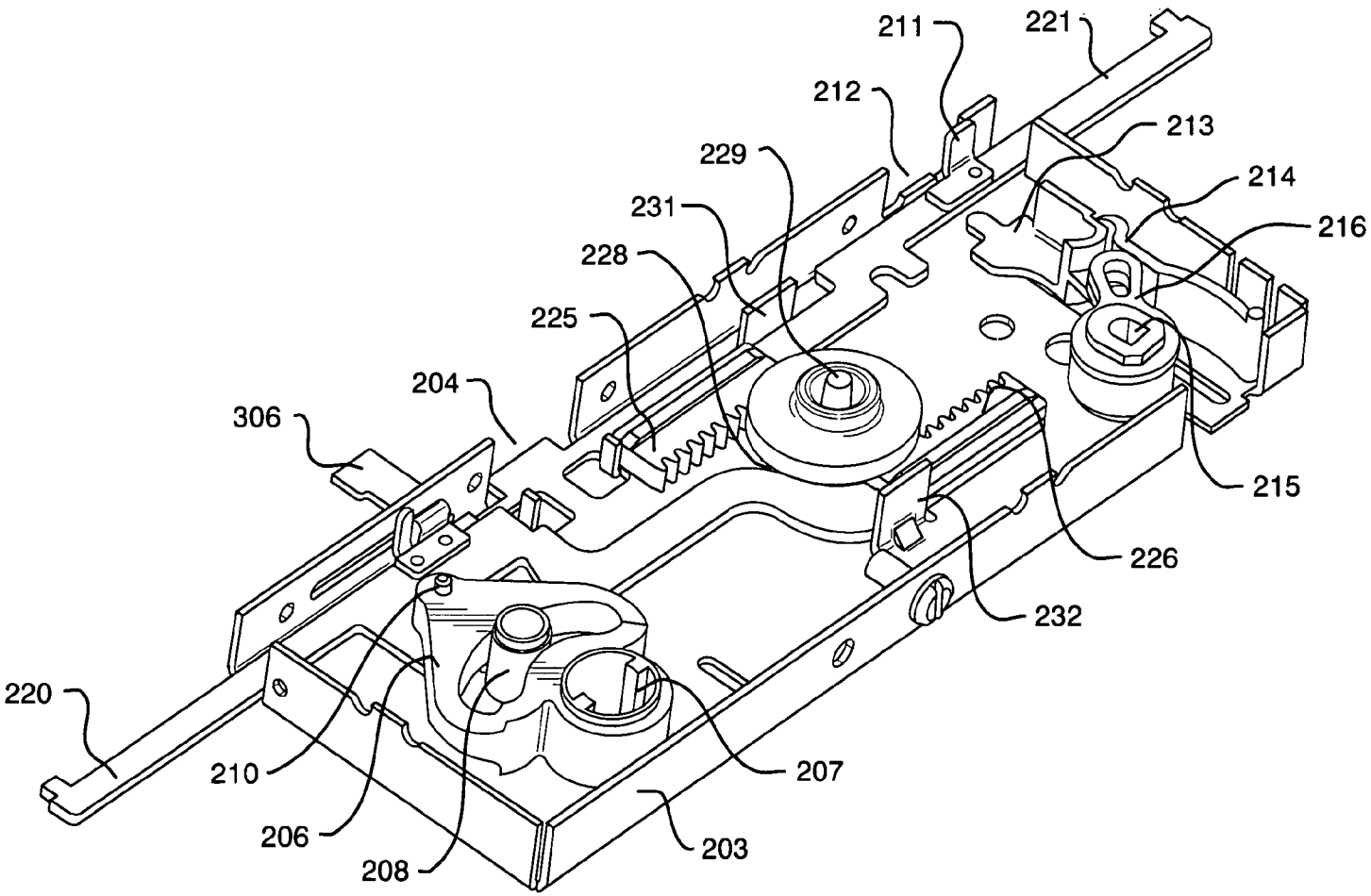
FIG. 20*b* is the astragal version of the second cassette of FIG. 20*a;*

In door sets where an astragal is employed, the multipoint door lock system 10 can be retrofitted to operate in this instance. Referring to FIGS. 17–18, an embodiment of the multipoint door lock system 10 used to compensate an astragal is depicted. This embodiment comprises a second lock mechanism—astragal version 300, which is similar to the second lock mechanism 200 previously described, with the exception of a few components. A modified set of faceplates, namely, a ninth faceplate 341, tenth faceplate 342, eleventh faceplate 343 and twelfth faceplate 344, attach the second lock mechanism—astragal version 300 to the leading edge of the inactive door 40. Starting from the cassette 202 (see FIGS. 19*b* and 20*b*), a window blocker drive 306 is added, shown in the retracted (FIG. 19*b*) and deployed (FIG. 20*b*) positions. The window blocker drive 306 extends towards a center strike plate 301 and is in mechanical communication with the strike plate 301 via a drive connector 307. A receiver window blocker slide 302 is slidably attached to the center strike plate 301, its back and forth sliding motion guided by a window blocker slide guide 303. Defined by the strike plate 301 and the window blocker slide 302 are a set of receiver windows 304 and 312. Receiver window 304 receives the latching member (latchbolt) 104 from the first lock mechanism 100, while receiver window 312 receives the locking member (deadbolt) 112 from the first lock mechanism 100. To block the receiver windows 304 and 312 to prevent engagement with the first lock mechanism 100, the window blocker slide 302 slides into a position to block the receiver windows 304 and 312. At the remote ends of the second lock mechanism—astragal version 300 (see FIGS. 17, 18, 24*a* and 24*b*), the actuator rods 236 and 237 each connect to a remote slide 349 and 348 respectively. Mechanically coupled to the remote slides 348 and 349 are sensor pad drives 358 and 359. The sensor-pad drives 358 and 359 each extend towards remote strike plates 352 and 353 and are attached to sensor pads 354 and 355 respectively. The sensor pads 354 and 355 are able to slide back and forth via sensor pad slides 356 and 357 of the remote strike plates 352 and 353 as shown. Further attached to remote slides 348 and 349 are remote blocker slides 372 and 373 respectively, which are mechanically linked to remote blocker drives 376 and 377 respectively. The remote blocker drives 376 and 377 extend towards the remote strike plates 352 and 353 and attach to a pair of remote window blockers 370 and 371 as shown. The remote window blockers 370 and 371 slidably fit within a set of remote receiver window slots 360 and 361 defined by the remote strike plates 352 and 353. When deployed, the remote window blockers 370 and 371 slide into position to block remote receiver window slots 360 and 361 from receiving the respective remote locking points of the first lock mechanism 100.

To further clarify the description of the invention, attention will be drawn to the functioning movements and positions of some of the key operating elements of one embodiment of the multipoint lock system 10. Starting with the first lock mechanism 100, the first input device 32 operates or moves the first primary actuator 106 housed within the first cassette 102. In mechanical communication with the first primary actuator 106 are the latching member 104 and the multi-tiered actuator system. Driven by the movement of the first primary actuator 106 are: the latching member 104, which is driven between a latching member retracted position (retracted) and a latching member deployed position (deployed), and at least one primary remote actuator 120,121,122,123, which is driven between a primary remote actuator retracted position (retracted) and a primary remote actuator extended position (extended). Driven by the at least one primary remote actuator 120,121, 122,123 (or the multi-tiered actuator system) are at least one primary remote locking point 160,161,190,191, which is driven between a primary remote locking point retracted position (retracted) and a primary remote locking point deployed position (deployed), and at least one sensor trigger mechanism 150,151, which it drives between an armed position and unarmed position. Also housed within the first cassette 102 is the locking member actuator 116. The locking member actuator 116, which is operated or moved by the second input device 34, drives the locking member 112 between a locking member retracted position (retracted) and a locking member deployed position (deployed).

Turning to the second lock mechanism 200, the third input device 42 operates or moves the second primary actuator 206 housed within the second cassette 202. Driven by the movement of the second primary actuator 206 is at least one secondary remote actuator 220,221, which is driven between a secondary remote actuator retracted position (retracted) and a secondary remote actuator extended position (extended). Driven by the at least one secondary remote actuator 220,221 are: the first receiver window blocker 205 between a first receiver window blocker retracted position (retracted) and a first receiver window blocker deployed position (deployed), a second receiver window blocker 211 between a second receiver window blocker retracted position (retracted) and a second receiver window blocker deployed position (deployed), at least one remote receiver window blocker 270,271 between a remote receiver window blocker retracted position (retracted) and a remote receiver window blocker deployed (deployed) position, at least one secondary remote locking point 290,291, between a secondary remote locking point retracted position (retracted) and a secondary remote locking point deployed position (deployed), and at least one sensor pad 254,255 between a sensor pad retracted position (retracted) and a sensor pad deployed position deployed). Also housed within the second cassette 202 is the lock actuator 216, which is operated or moved by the fourth input device 44, and drives the secondary remote actuator lock 213 between a secondary remote actuator lock retracted position (retracted) and a secondary remote actuator lock deployed position (deployed).

Having thus described the components of the multipoint lock system 10 as well as the functioning movements and positions of some of its key operating elements, attention will now be drawn to one example of its operation starting with the first lock mechanism 100. With the active door 30 in the closed position and all engaging means of the first lock mechanism 100 (latchbolt 104, deadbolt 112, remote locking points 160,161 and 190,191) in their deployed positions, turning the second input device or thumbturn 34 inserted into the locking member hub 115 will retract the locking member or deadbolt 112. This in turn allows the first input device or handle 32 inserted into the latching member hub 107, to be moved in a first direction, which can be either upward or downward depending on the embodiment; in the current embodiment, the first direction is a downward. Movement in the downward direction initiates the automatic function of the system 10 by retracting the latchbolt 104 along with the remote locking points 160,161 (either deadbolt locks 180,181 or tongue locks 170,171) and 190,191 (shootbolts), and by arming the sensor-trigger mechanisms 150,151. At this point the active door 30 may now be opened in the typical manner.

The action as described above is accomplished by the rotation of the first primary actuator 106, which positions the remote actuator drive pin 110. Said remote actuator drive pin 110 drives the first primary remote actuator lower tier 120 and the first primary remote actuator upper tier 122, as well as the actuator rod 136 and the primary remote slide 148, towards the first cassette 102 thereby retracting the remote locking points 160 (either deadbolt lock 180 or tongue lock 170) and 190 (shootbolt). This motion is also transmitted to the second primary remote actuator lower tier 121 and the second primary remote actuator upper tier 123, as well as the actuator rod 137 and the primary remote slide 149 via the multi-tiered rack and pinion gearing system 125,126,127, 128,129. Hence, the second primary remote actuators upper and lower tier 121,123, as well as the actuator rod 137 and primary remote slide 149, are pulled inward towards the first cassette 102 allowing the remote locking points 161 (deadbolt lock 181 or tongue lock 171) and 191 (shootbolt) to be retracted.

Latching and locking of the inactive and active doors 30,40 via the automatic function is accomplished by simply closing the doors and making contact with the jamb. The latching member or latchbolt 104 will penetrate the corresponding receiver window 204 of the second lock mechanism 200. When the door is in the nearly completely closed position, the remote sensor triggers 154 and 155 will contact the sensor pads 254, 255 (354,355 if an astragal is used) positioned at corresponding points along the second lock mechanism 200, which in turn displaces the slide hooks 159 from the hook slots 163. This displacement releases the spring loaded sensor slides 152 and 153 of the sensor-trigger mechanisms 150,151, which in turn drives the attached primary remote slides 148 and 149 forward (away from the first cassette 102), which further in turn deploys the remote locking points 160,161,190, and 191.

In the event the remote locking points 160,161,190,191 do not deploy automatically and to their full extent, a movement of the first input device or handle 32 in a second direction (opposite the first direction), which in this embodiment is an upward direction, will operate the automatic function of the system 10, which manually deploys the remote locking points 160,161 to the fullest extent possible. If however, movement in the second direction is not possible, this is an indication that one or both of the trigger mechanisms 150,151 has not fired. This movement of the handle in the second direction will also tend to fully deploy the primary remote locking points, in this case shootbolts 190,191, should they have met some resistance.

At this point, the locking member or deadbolt 112 may be deployed which in turn prevents any further movement of the first and second primary remote actuators upper tier 120 and 121 and prevents the input device or handle 32 from being moved in the first direction. However, the handle 32 can still be moved in the second direction, which again allows for further deployment of the remote locking points 160,161,190,191, but no unlocking (retracting) action. The deadbolt lock spring 114 locks the deadbolt 112 in the deployed or engaging position. This locking action prevents the retraction of the deadbolt 112 by direct pressure applied to the end or any other exposed surface. Hence, the only way the deadbolt 112 may be retracted/moved is by rotating the thumbturn 34. It should be noted that the deadbolt 112 may be deployed at any given time even if the remote locking points 160,161,190,191 have completely failed to deploy. This is accomplished by the use of a return spring 124 attached to the first primary remote actuator lower tier 120. Thus, the deadbolt deploy/lock features are always in alignment and ready for full engagement.

Attention is now drawn to the operation of the second lock mechanism 200, which co-acts with the first lock mechanism 100. Starting from the center cassette 202, movement of the handle 42 in a third direction, which can be either upward or downward, but is downward in the current embodiment, is transmitted to the second primary actuator 206 via the actuator hub 207, thereby rotating the second primary actuator 206. The remote actuator drive pin 210 affixed to the actuator 206 contacts the secondary remote actuator 220, pulling it towards the cassette 202. This motion is transmitted to the other secondary remote actuator 221 via rack and pinion gearing 225,226,228,229, which pulls said actuator towards the cassette 202, but in the opposite direction. The movement of the secondary remote actuators 220 and 221 imparts a corresponding movement to the actuator rods 236,237 and the remote slides 248,249, which in turn places the first receiver window blocker 205, the second receiver window blocker 211 and the remote receiver window blockers 270 and 271 into their respective blocking or receiver window blocker deployed positions. In this position, the first receiver window 204, the second receiver window 212 and the remote receiver windows 260,261 are blocked thereby preventing the latchbolt 104, deadbolt 112 and remote locking points 160,161 (either deadbolt locks 180,181 or tongue locks 170,171) from entering said receiver windows, which ultimately prevents the first lock mechanism 100 from engaging the second lock mechanism 200. Additionally, movement of the handle 42 in the third direction positions at least one secondary remote locking point 290, 291 in the secondary remote locking point retracted position. Furthermore, movement of the handle 42 in the third direction places the sensor pads 254 and 255 in the sensor pad retracted position, which misaligns the sensor pads and their corresponding sensor triggers 154 and 155, thereby preventing the contact required to facilitate the automatic deployment of the remote locking members 160, 161,190 and 191. The abovementioned action is achievable only if the secondary remote actuator lock 213 is moved out of engagement with the secondary remote actuator 221 by rotating the thumbturn 42. If the secondary remote actuator lock 213 is in engagement with the secondary remote actuator 221, movement of the handle 42 in the third direction is prevented; however, movement in a fourth direction opposite the third direction is still possible as described below).

Movement of the handle in a fourth direction, which can be upward or downward, but is upward in this embodiment, positions the secondary locking points or shootbolts 290 and 291 into the secondary locking point deployed position, and moves the first receiver window blocker 205, the second receiver window blocker 211 and the remote receiver window blockers 270 and 271 out of blocking position or in their respective receiver window blocker retracted positions. This in turn opens the first receiver window 204, the second receiver window 212 and the remote receiver windows 260,261, thereby allowing the latchbolt 104, the deadbolt 112 and the remote locking points 160 and 161 to deploy and matingly engage said receiver windows, which ultimately allows the first lock mechanism 100 to engage the second lock mechanism 200. Additionally, movement of the handle 42 in the fourth direction places the sensor pads 254 and 255 in the sensor pad deployed position, which aligns the sensor pads 254 and 255 with their corresponding remote sensor triggers 154 and 155 to allow for automatic deployment of the remote locking members 160,161 190,191 upon contact. When the secondary remote locking points or shootbolts 290 and 291 are deployed, the receiver windows 204,212,260, 261 unblocked or open, and the sensor pads 254,255 aligned with the sensor triggers 154 and 155, said components can be locked in those positions with a turn of the thumbturn 42, which engages the secondary remote actuator lock 213 and locks out the lever 42 movement in the third direction; however, movement of handle 42 in the fourth direction is still possible, which would only further deploy the secondary remote locking points 290 and 291.

Although only a few exemplary embodiments of this invention have been described in detail above, those skilled in the art will readily appreciate than many modifications are possible in the exemplary embodiments without materially departing from the novel teachings and advantages of this invention. For example, various input devices and/or different handle configurations may be employed, various alternative mechanisms may be used to provide locking, receiving and/or positioning actions, different shootbolt and/or remote locking points (in addition to deadbolts and tongues) may be used, members or elements may be coupled (or may co-act) directly or indirectly (e.g. through other intermediate links or structures), and the door lock mechanisms of the multipoint lock system may be applied to different door arrangements or configurations. Accordingly, all such modifications are intended to be included within the scope of the invention as defined in the following claims. Furthermore, a variety of mechanisms may be applied to carry out the functions of the multipoint lock system. Although members and elements may be shown as directly or indirectly coupled/attached in the exemplary embodiments, the present invention should not be considered to be limited to such couplings (e.g. such couplings/attachments may be direct or indirect) within the spirit and scope of the present invention. Additionally, in reference to the exact number of each component or element used in a particular embodiment of the invention, it should be noted that each component or element can vary in number, but in any case, at least one of every component or element can be employed.

The method of operation of the multipoint lock system according to the preferred and alternative embodiments of the invention may be performed in various steps; any omissions or additions of steps to those steps disclosed, or any departure from the order or sequence of steps recited, should be considered to fit within the spirit and scope of the present invention.

Furthermore, other substitutions, modifications, changes, and omissions may be made in the design, size or proportion, materials, operating conditions, and arrangement of the embodiments of the present disclosure without departing from the spirit and scope of the invention as described in the appended claims.

What is claimed is:

1. A multipoint lock system for locking a pair of doors, the system comprising:

a first lock mechanism adapted to be operably coupled with a first door of the pair of doors and a second lock mechanism adapted to be operably coupled with a second door of the pair of doors, said second lock mechanism having an open condition and a blocked condition, wherein said first lock mechanism engages said second lock mechanism when said second lock mechanism is in said open condition, and wherein said first lock mechanism is prevented from engaging said second lock mechanism when said second lock mechanism is in said blocked condition, said first lock mechanism including a first primary actuator and at least one primary remote actuator in mechanical communication with the first primary actuator, the second lock mechanism including a second primary actuator and at least one secondary remote actuator in mechanical communication with the second primary actuator, wherein the first lock mechanism comprises at least one sensor trigger mechanism having at least one sensor trigger, wherein the at least one sensor-trigger mechanism is operably coupled with and driven by the at least one primary remote actuator; and wherein the second lock mechanism includes at least one sensor pad, wherein the at least one sensor pad is operably coupled with and driven by the at least one secondary remote actuator.

2. The multipoint lock system of claim 1:

wherein said first lock mechanism further comprises;

a first cassette; the first primary actuator housed within said first cassette;

a first input device for operating said first primary actuator;

a latching member driven by the movement of said first primary actuator;

a locking member actuator housed within said first cassette;

a second input device for operating said locking member actuator;

a locking member driven by the movement of said locking member actuator;

at least one primary remote locking point driven by the movement of said at least one primary remote actuator; and wherein said second lock mechanism further comprises;

at least one faceplate, said at least one face plate defining a first receiver window, and a second receiver window;

a second cassette mounted to said at least one faceplate, said second cassette having a housing, wherein said housing further defines said first receiver window and said second receiver window, the second primary actuator being housed within said second cassette;

a third input device for operating said second primary actuator;

a first receiver window blocker attached to said at least one secondary remote actuator;

a second receiver window blocker attached to said at least one secondary remote actuator;

at least one remote receiver window blocker mechanically linked to said at least one secondary remote actuator; and at least one secondary remote locking point driven by the movement of said at least one secondary remote actuator.

3. The multipoint lock system of claim 2 further comprising:

a lock actuator housed in said second cassette; a fourth input device for operating said lock actuator; and a secondary remote actuator lock actuated by said lock actuator, wherein said secondary remote actuator lock releasably engages said at least one secondary remote actuator.

4. The multipoint lock system of claim 3, wherein said fourth input device is a thumbturn.

5. The multipoint lock system of claim 2, wherein said first lock mechanism comprises a plurality of primary remote locking points.

6. The multipoint lock system of claim 5, wherein said plurality of remote locking points comprises at least one deadbolt lock and at least one shootbolt.

7. The multipoint lock system of claim 5, wherein said plurality of remote locking points comprises at least one tongue lock and at least one shootbolt.

8. The multipoint lock system of claim 2, wherein said latching member is a latchbolt.

9. The multipoint lock system of claim 2, wherein said locking member is a deadbolt.

10. The multipoint lock system of claim 2, wherein said at least one remote locking point is a tongue lock.

11. The multipoint lock system of claim 2, wherein said at least one remote locking point is a deadbolt lock.

12. The multipoint lock system of claim 2, wherein said at least one remote locking point is a shootbolt.

13. The multipoint lock system of claim 2, wherein said first input device is a handle.

14. The multipoint lock system of claim 2, wherein said second input device is a thumbturn.

15. The multipoint lock system of claim 2, wherein said third input device is a handle.

16. A multipoint lock system for use in locking an active door and an inactive door of a two-door set comprising:

a first lock mechanism attached to said active door and a second lock mechanism attached to said inactive door, said second lock mechanism having an open condition and a blocked condition, wherein said first lock mechanism engages said second lock mechanism when said second lock mechanism is in said open condition, and wherein said first lock mechanism is prevented from engaging said second lock mechanism when said second lock mechanism is in said blocked condition, said first lock mechanism including a first primary actuator and a multi-tiered remote actuator system in mechanical communication with the first primary actuator, the second lock mechanism including a second primary actuator and at least one secondary remote actuator in mechanical communication with the second primary actuator, wherein said at least one secondary remote actuator is driven by the movement of said second primary actuator between a secondary remote actuator refracted position and a secondary remote actuator extended position, wherein the first lock mechanism comprises at least one sensor trigger mechanism having at least one sensor trigger, wherein said sensor trigger mechanism is driven by said multi-tiered actuator system between an armed position and an unarmed position, wherein the second lock mechanism includes at least one sensor pad, wherein said sensor pad is driven by said at least one secondary remote actuator between a sensor pad retracted position and a sensor pad deployed position, and wherein said at least one sensor pad is in mechanical alignment with said at least one sensor trigger while in the deployed position.

17. The multipoint lock system of claim 16:

wherein said first lock mechanism further comprises;

at least one active-door faceplate;

a first cassette mounted to said at least one active-door faceplate, said first cassette having a housing;

the first primary actuator being housed within said first cassette;

a first input device for operating said first primary actuator;

a latching member driven by the movement of said first primary actuator between a latching member retracted position and a latching member deployed position;

a locking member actuator housed within said first cassette;

a second input device for operating said locking member actuator;

a locking member driven by the movement of said locking member actuator between a locking member refracted position and a locking member deployed position;

at least one primary remote locking point driven by the movement of said multi-tiered remote actuator system between a primary remote locking point retracted position and a primary remote locking point deployed position; and wherein said second lock mechanism further comprises;

at least one faceplate, said at least one face plate defining a first receiver window for receiving said latching member, a second receiver window for receiving said locking member and at least one remote receiver window for receiving said at least one primary remote locking point;

a second cassette mounted to said faceplate, said second cassette having a housing, wherein said housing further defines said first receiver window and said second receiver window;

the second primary actuator being housed within said second cassette; a third input device for operating said second primary actuator, said third input device capable of moving between a third direction and a fourth direction;

a first receiver window blocker driven by the movement of said at least one secondary remote actuator between a first receiver window blocker retracted position and a first receiver window blocker deployed position, wherein said first receiver window blocker blocks said first receiver window from receiving said latching member while in said first receiver window blocker deployed position;

a second receiver window blocker driven by the movement of said at least one secondary remote actuator between a second receiver window blocker retracted position and a second receiver window blocker deployed position, wherein said second receiver window blocker blocks said first receiver window from receiving said locking member while in said second receiver window blocker deployed position;

at least one remote receiver window blocker driven by the movement of said at least one secondary remote actuator between a remote receiver window blocker refracted position and a remote receiver window blocker deployed position, wherein said at least one remote receiver window blocker blocks said at least one remote receiver window from receiving said at least one primary remote locking point while in the remote receiver window blocker deployed position; and at least one secondary remote locking point driven by the movement of said at least one secondary remote actuator between a secondary remote locking point retracted position and a secondary remote locking point deployed position.

18. The multipoint lock system of claim 17 wherein movement of said third input device in said third direction positions said at least one sensor pad in said sensor pad retracted position and movement of said third input device in said fourth direction positions said at least one sensor pad in said sensor pad deployed position.

19. The multipoint lock system of claim 17 wherein said multi-tiered actuator system comprises:

an upper tier having at least one primary remote actuator upper tier and a lower tier having at least one primary remote actuator lower tier, wherein said at least one primary remote actuator upper tier acts independently of said at least one primary remote actuator lower tier, and wherein said at least one primary remote actuator upper tier and at least one primary remote actuator lower tier are each driven by the movement of said first primary actuator between a primary remote actuator retracted position and a primary remote actuator extended position.

20. The multipoint lock system of claim 17, wherein said multi-tiered actuator system further comprises:

an upper tier having a first primary remote actuator upper tier and a second primary remote actuator upper tier; and a lower tier having a first primary remote actuator lower tier and a second primary remote actuator lower tier, wherein said first primary remote actuator upper tier and said second primary remote actuator upper tier act independently of said first primary remote actuator lower tier and said second primary remote actuator lower tier, and wherein said first primary remote actuator upper tier, said first primary remote actuator lower tier, said second primary remote actuator upper tier and said second primary remote actuator lower tier are each driven by the movement of said first primary actuator between a primary remote actuator retracted position and a primary remote actuator extended position.

21. The multipoint lock system of claim 19, wherein movement of said first input device in a first direction operates an automatic locking function of said multipoint lock system to position said sensor-trigger mechanism into said armed position and to position said at least one primary remote locking point into said primary remote locking point refracted position, and wherein movement of said first input device in a second direction operates a manual locking function of said multipoint lock system to manually position said at least one primary remote locking point into said primary remote locking point deployed position.

22. The multipoint lock system of claim 21, wherein said upper tier substantially operates said manual locking function and said lower tier substantially operates said automatic locking function.

23. The multipoint lock system of claim 21, wherein said lower tier substantially operates said manual locking function and said upper tier substantially operates said automatic locking function.

24. The multipoint lock system of claim 21, wherein said locking member, while in the deployed position, prevents said first input device from moving in said first direction.

25. The multipoint lock system of claim 16, wherein said second lock mechanism comprises two secondary remote actuators, each driven in opposite directions by said at least one secondary remote actuator between said secondary remote actuator extended position and said secondary remote actuator refracted position.

26. The multipoint lock system of claim 16, wherein movement of said third input device in said third direction positions said first receiver window blocker in said first receiver window blocker deployed position, said second receiver window blocker in said second receiver window blocker deployed position, said at least one remote receiver window blocker in said remote receiver window blocker deployed position, and said at least one secondary remote locking point in said secondary remote locking point retracted position, and wherein movement of said third input device in said fourth direction positions said first receiver window blocker in said first receiver window blocker retracted position, said second receiver window blocker in said second receiver window blocker refracted position, said at least one remote receiver window blocker in said remote receiver window blocker retracted position, and said at least one secondary remote locking point in said secondary remote locking point deployed position.

27. The multipoint lock system of claim 17 further comprising: a lock actuator housed within said second cassette; a fourth input device for operating said lock actuator; and a secondary remote actuator lock, which is driven by said lock actuator between a secondary remote actuator lock retracted position and a secondary remote actuator lock deployed position.

28. The multipoint lock system of claim 27, wherein said secondary remote actuator lock while in the deployed position prevents said third input device from moving in said third direction.

29. The multipoint lock system of claim 27, wherein said fourth input device is a thumbturn.

30. The multipoint lock system of claim 17, wherein said first lock mechanism comprises a plurality of primary remote locking points.

31. The multipoint lock system of claim 30, wherein said plurality of remote locking points comprises at least one deadbolt lock and at least one shootbolt.

32. The multipoint lock system of claim 30, wherein said plurality of remote locking points comprises at least one tongue lock and at least one shootbolt.

33. The multipoint lock system of claim 17, wherein said latching member is a latchbolt.

34. The multipoint lock system of claim 17, wherein said locking member is a deadbolt.

35. The multipoint lock system of claim 17, wherein said at least one remote locking point is a tongue lock.

36. The multipoint lock system of claim 17, wherein said at least one remote locking point is a deadbolt lock.

37. The multipoint lock system of claim 17, wherein said at least one remote locking point is a shootbolt.

38. The multipoint lock system of claim 17, wherein said first input device is a handle.

39. The multipoint lock system of claim 17, wherein said second input device is a thumbturn.

40. The multipoint lock system of claim 17, wherein said third input device is a handle.

* * * * *